US006488353B1

(12) United States Patent
Itoyama et al.

(10) Patent No.: US 6,488,353 B1
(45) Date of Patent: Dec. 3, 2002

(54) IMAGE FORMING APPARATUS DIAGNOSING PRINT HEAD AND OPTICAL SYSTEM CONDITIONS BASED ON PRINTED TEST PATTERN

(75) Inventors: Motoyuki Itoyama, Kyoto (JP); Michiyuki Suzuki, Nara (JP); Yoshio Mizuyama, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 3 days.

(21) Appl. No.: 09/584,313

(22) Filed: May 31, 2000

(30) Foreign Application Priority Data

Jun. 18, 1999 (JP) ..... 11-172867

(51) Int. Cl.[7] ..... B41J 29/393
(52) U.S. Cl. ..... 347/19
(58) Field of Search ..... 347/19, 22, 23, 347/24; 358/502, 504, 406, 505, 474

(56) References Cited

U.S. PATENT DOCUMENTS 4,493,993 A * 1/1985 Kanamuller et al. ..... 347/19
5,140,429 A * 8/1992 Ebinuma et al. ..... 347/19
5,534,895 A * 7/1996 Lindenfelser et al. ..... 347/19
5,963,225 A * 10/1999 Sugiyama ..... 347/19
6,373,983 B1 * 4/2002 Tsai ..... 358/474

FOREIGN PATENT DOCUMENTS

JP 09240017 9/1997

* cited by examiner

*Primary Examiner*—John Barlow
*Assistant Examiner*—Julian D. Huffman
(74) *Attorney, Agent, or Firm*—Renner, Otto, Boisselle & Sklar

(57) ABSTRACT

An image forming apparatus which can detect a defect in a nozzle and an optical system, and inform an execution of maintenance.

The apparatus comprises a scanner which reads an image; a print head which prints an image; a test pattern image data ROM stored a test pattern; and an image processing unit which diagnoses a defect in the print head and the scanner by processing data of the test pattern which is read by the scanner.

9 Claims, 30 Drawing Sheets

BOTTOM VIEW OF INK HEAD

◆IN THE CASE OF OF FOUR COLOR INK (CYAN/MAGENTA/YELLOW/BLACK)

300dpi(1dot=80～85 μm)

※One dot is printed with a jet from one nozzle in order from the top nozzle in each of the cyan,magenta,yellow, and black cartridges,With each movement in the main scanning direction by one pixel.

FIG.18

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | 255 | 255 | 255 | 255 | 255 | 255 | 255 | 255 | 255 | 255 | 255 | | 255 | 255 | 255 | 255 | 255 | 255 |
| CYAN 2ND ROW | 255 | 255 | 255 | 255 | 255 | 255 | 255 | 255 | 255 | 255 | 255 | | 255 | 255 | 255 | 255 | 255 | 255 |
| CYAN 3RD ROW | 255 | 255 | 255 | 255 | 255 | 255 | 255 | 255 | 255 | 255 | 255 | | 255 | 255 | 255 | 255 | 255 | 255 |
| CYAN NTH ROW | 255 | 255 | 255 | 255 | 255 | 255 | 255 | 255 | 255 | 255 | 255 | | 255 | 255 | 255 | 255 | 255 | 255 |
| MAGENTA 1ST ROW | 255 | 255 | 255 | 255 | 255 | 255 | 255 | 255 | 255 | 255 | 255 | | 255 | 255 | 255 | 255 | 255 | 255 |
| MAGENTA 2ND ROW | 255 | 255 | 255 | 255 | 255 | 255 | 255 | 255 | 255 | 255 | 255 | | 255 | 255 | 255 | 255 | 255 | 255 |
| MAGENTA 3RD ROW | 255 | 255 | 255 | 255 | 255 | 255 | 255 | 255 | 255 | 255 | 255 | | 255 | 255 | 255 | 255 | 255 | 255 |
| MAGENTA NTH ROW | 255 | 255 | 255 | 255 | 255 | 255 | 255 | 255 | 255 | 255 | 255 | | 255 | 255 | 255 | 255 | 255 | 255 |
| YELLOW 1ST ROW | 255 | 255 | 255 | 255 | 255 | 255 | 255 | 255 | 255 | 255 | 255 | | 255 | 255 | 255 | 255 | 255 | 255 |
| YELLOW 2ND ROW | 255 | 255 | 255 | 255 | 255 | 255 | 255 | 255 | 255 | 255 | 255 | | 255 | 255 | 255 | 255 | 255 | 255 |
| YELLOW 3RD ROW | 255 | 255 | 255 | 255 | 255 | 255 | 255 | 255 | 255 | 255 | 255 | | 255 | 255 | 255 | 255 | 255 | 255 |
| YELLOW NTH ROW | 255 | 255 | 255 | 255 | 255 | 255 | 255 | 255 | 255 | 255 | 255 | | 255 | 255 | 255 | 255 | 255 | 255 |
| BLACK 1ST ROW | 255 | 255 | 255 | 255 | 255 | 255 | 255 | 255 | 255 | 255 | 255 | | 255 | 255 | 255 | 255 | 255 | 255 |
| BLACK 2ND ROW | 255 | 255 | 255 | 255 | 255 | 255 | 255 | 255 | 255 | 255 | 255 | | 255 | 255 | 255 | 255 | 255 | 255 |
| BLACK 3RD ROW | 255 | 255 | 255 | 255 | 255 | 255 | 255 | 255 | 255 | 255 | 255 | | 255 | 255 | 255 | 255 | 255 | 255 |
| BLACK NTH ROW | 255 | 255 | 255 | 255 | 255 | 255 | 255 | 255 | 255 | 255 | 255 | | 255 | 255 | 255 | 255 | 255 | 255 |

FIG.19

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | 250 | 249 | 250 | 253 | 241 | 249 | 244 | 244 | 255 | 241 | 242 | | 244 | 250 | 245 | 241 | 245 | 251 |
| CYAN 2ND ROW | 252 | 240 | 248 | 245 | 242 | 252 | 247 | 254 | 246 | 253 | 250 | | 245 | 254 | 244 | 244 | 248 | 244 |
| CYAN 3RD ROW | 242 | 255 | 240 | 244 | 244 | 254 | 246 | 243 | 243 | 247 | 255 | | 245 | 254 | 255 | 252 | 252 | 249 |
| CYAN NTH ROW | 240 | 244 | 242 | 246 | 253 | 250 | 244 | 247 | 255 | 245 | 245 | | 252 | 253 | 249 | 240 | 248 | 240 |
| MAGENTA 1ST ROW | 249 | 247 | 247 | 245 | 247 | 242 | 251 | 253 | 244 | 242 | 245 | | 245 | 246 | 246 | 252 | 242 | 245 |
| MAGENTA 2ND ROW | 255 | 240 | 253 | 240 | 255 | 242 | 240 | 255 | 247 | 247 | 246 | | 249 | 247 | 249 | 246 | 252 | 247 |
| MAGENTA 3RD ROW | 247 | 247 | 241 | 241 | 248 | 248 | 250 | 244 | 240 | 251 | 245 | | 245 | 247 | 241 | 254 | 249 | 240 |
| MAGENTA NTH ROW | 242 | 246 | 252 | 243 | 254 | 249 | 250 | 241 | 252 | 252 | 244 | | 255 | 244 | 243 | 246 | 253 | 244 |
| YELLOW 1ST ROW | 254 | 246 | 241 | 249 | 242 | 243 | 248 | 243 | 241 | 246 | 247 | | 251 | 250 | 248 | 254 | 248 | 244 |
| YELLOW 2ND ROW | 245 | 246 | 241 | 254 | 254 | 243 | 243 | 242 | 244 | 243 | 255 | | 248 | 252 | 241 | 251 | 250 | 252 |
| YELLOW 3RD ROW | 252 | 250 | 244 | 246 | 249 | 248 | 240 | 240 | 254 | 254 | 243 | | 243 | 246 | 247 | 252 | 252 | 244 |
| YELLOW NTH ROW | 249 | 249 | 252 | 246 | 250 | 254 | 242 | 246 | 246 | 246 | 247 | | 243 | 246 | 252 | 255 | 251 | 255 |
| BLACK 1ST ROW | 242 | 249 | 249 | 241 | 248 | 249 | 253 | 254 | 242 | 254 | 247 | | 255 | 246 | 252 | 243 | 240 | 247 |
| BLACK 2ND ROW | 250 | 254 | 240 | 252 | 247 | 247 | 250 | 254 | 247 | 242 | 248 | | 241 | 244 | 242 | 241 | 246 | 251 |
| BLACK 3RD ROW | 251 | 247 | 250 | 243 | 255 | 250 | 248 | 253 | 248 | 240 | 248 | | 253 | 244 | 244 | 244 | 255 | 250 |
| BLACK NTH ROW | 251 | 248 | 252 | 254 | 255 | 244 | 253 | 249 | 249 | 255 | 253 | | 248 | 249 | 248 | 242 | 246 | 244 |

FIG.20

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | ○ | ○ | ○ | ○ | ○ | ○ | ○ | ○ | ○ | ○ | ○ | | ○ | ○ | ○ | ○ | ○ | ○ |
| CYAN 2ND ROW | ○ | ○ | ○ | ○ | ○ | ○ | ○ | ○ | ○ | ○ | ○ | | ○ | ○ | ○ | ○ | ○ | ○ |
| CYAN 3RD ROW | ○ | ○ | ○ | ○ | ○ | ○ | ○ | ○ | ○ | ○ | ○ | | ○ | ○ | ○ | ○ | ○ | ○ |
| CYAN NTH ROW | ○ | ○ | ○ | ○ | ○ | ○ | ○ | ○ | ○ | ○ | ○ | | ○ | ○ | ○ | ○ | ○ | ○ |
| MAGENTA 1ST ROW | ○ | ○ | ○ | ○ | ○ | ○ | ○ | ○ | ○ | ○ | ○ | | ○ | ○ | ○ | ○ | ○ | ○ |
| MAGENTA 2ND ROW | ○ | ○ | ○ | ○ | ○ | ○ | ○ | ○ | ○ | ○ | ○ | | ○ | ○ | ○ | ○ | ○ | ○ |
| MAGENTA 3RD ROW | ○ | ○ | ○ | ○ | ○ | ○ | ○ | ○ | ○ | ○ | ○ | | ○ | ○ | ○ | ○ | ○ | ○ |
| MAGENTA NTH ROW | ○ | ○ | ○ | ○ | ○ | ○ | ○ | ○ | ○ | ○ | ○ | | ○ | ○ | ○ | ○ | ○ | ○ |
| YELLOW 1ST ROW | ○ | ○ | ○ | ○ | ○ | ○ | ○ | ○ | ○ | ○ | ○ | | ○ | ○ | ○ | ○ | ○ | ○ |
| YELLOW 2ND ROW | ○ | ○ | ○ | ○ | ○ | ○ | ○ | ○ | ○ | ○ | ○ | | ○ | ○ | ○ | ○ | ○ | ○ |
| YELLOW 3RD ROW | ○ | ○ | ○ | ○ | ○ | ○ | ○ | ○ | ○ | ○ | ○ | | ○ | ○ | ○ | ○ | ○ | ○ |
| YELLOW NTH ROW | ○ | ○ | ○ | ○ | ○ | ○ | ○ | ○ | ○ | ○ | ○ | | ○ | ○ | ○ | ○ | ○ | ○ |
| BLACK 1ST ROW | ○ | ○ | ○ | ○ | ○ | ○ | ○ | ○ | ○ | ○ | ○ | | ○ | ○ | ○ | ○ | ○ | ○ |
| BLACK 2ND ROW | ○ | ○ | ○ | ○ | ○ | ○ | ○ | ○ | ○ | ○ | ○ | | ○ | ○ | ○ | ○ | ○ | ○ |
| BLACK 3RD ROW | ○ | ○ | ○ | ○ | ○ | ○ | ○ | ○ | ○ | ○ | ○ | | ○ | ○ | ○ | ○ | ○ | ○ |
| BLACK NTH ROW | ○ | ○ | ○ | ○ | ○ | ○ | ○ | ○ | ○ | ○ | ○ | | ○ | ○ | ○ | ○ | ○ | ○ |

FIG.21

| CASE | No.1 | No.2 | No.3 | No.4 |
|---|---|---|---|---|
| INK HEAD DEFECT | NO DEFECT | DEFECTIVE | NO DEFECT | DEFECTIVE |
| OPTICAL DEFECT | NO DEFECT | NO DEFECT | DEFECTIVE | DEFECTIVE |

FIG.23

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | 255 | 255 | 255 | 255 | 255 | 255 | 255 | 255 | 255 | 255 | 255 | | 255 | 255 | 255 | 255 | 255 | 255 |
| CYAN 2ND ROW | 255 | 255 | 255 | 255 | 255 | 255 | 255 | 255 | 255 | 255 | 255 | | 255 | 255 | 255 | 255 | 255 | 255 |
| CYAN 3RD ROW | 255 | 255 | 255 | 255 | 255 | 255 | 255 | 255 | 255 | 255 | 255 | | 255 | 255 | 255 | 255 | 255 | 255 |
| CYAN NTH ROW | 255 | 255 | 255 | 255 | 255 | 255 | 255 | 255 | 255 | 255 | 255 | | 255 | 255 | 255 | 255 | 255 | 255 |
| MAGENTA 1ST ROW | 255 | 255 | 255 | 255 | 255 | 255 | 255 | 255 | 255 | 255 | 255 | | 255 | 255 | 255 | 255 | 255 | 255 |
| MAGENTA 2ND ROW | 255 | 255 | 255 | 255 | 255 | 255 | 255 | 255 | 255 | 255 | 255 | | 255 | 255 | 255 | 255 | 255 | 255 |
| MAGENTA 3RD ROW | 255 | 255 | 255 | 255 | 255 | 255 | 255 | 255 | 255 | 255 | 255 | | 255 | 255 | 255 | 255 | 255 | 255 |
| MAGENTA NTH ROW | 255 | 255 | 255 | 255 | 255 | 255 | 255 | 255 | 255 | 255 | 255 | | 255 | 255 | 255 | 255 | 255 | 255 |
| YELLOW 1ST ROW | 255 | 255 | 255 | 255 | 255 | 255 | 255 | 255 | 255 | 255 | 255 | | 255 | 255 | 255 | 255 | 255 | 255 |
| YELLOW 2ND ROW | 255 | 255 | 255 | 255 | 255 | 255 | 255 | 255 | 255 | 255 | 255 | | 255 | 255 | 255 | 255 | 255 | 255 |
| YELLOW 3RD ROW | 255 | 255 | 255 | 255 | 255 | 255 | 255 | 255 | 255 | 255 | 255 | | 255 | 255 | 255 | 255 | 255 | 255 |
| YELLOW NTH ROW | 255 | 255 | 255 | 255 | 255 | 255 | 255 | 255 | 255 | 255 | 255 | | 255 | 255 | 255 | 255 | 255 | 255 |
| BLACK 1ST ROW | 255 | 255 | 255 | 255 | 255 | 255 | 255 | 255 | 255 | 255 | 255 | | 255 | 255 | 255 | 255 | 255 | 255 |
| BLACK 2ND ROW | 255 | 255 | 255 | 255 | 255 | 255 | 255 | 255 | 255 | 255 | 255 | | 255 | 255 | 255 | 255 | 255 | 255 |
| BLACK 3RD ROW | 255 | 255 | 255 | 255 | 255 | 255 | 255 | 255 | 255 | 255 | 255 | | 255 | 255 | 255 | 255 | 255 | 255 |
| BLACK NTH ROW | 255 | 255 | 255 | 255 | 255 | 255 | 255 | 255 | 255 | 255 | 255 | | 255 | 255 | 255 | 255 | 255 | 255 |

FIG.24

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | 252 | 252 | 255 | 240 | 254 | 249 | 254 | 244 | 248 | 251 | 253 | | 253 | 249 | 242 | 244 | 244 | 242 |
| CYAN 2ND ROW | 127 | 131 | 105 | 100 | 130 | 106 | 150 | 113 | 105 | 100 | 147 | | 110 | 134 | 137 | 112 | 125 | 106 |
| CYAN 3RD ROW | 240 | 242 | 249 | 244 | 248 | 251 | 255 | 242 | 244 | 242 | 246 | | 240 | 249 | 251 | 244 | 243 | 247 |
| CYAN NTH ROW | 250 | 253 | 242 | 248 | 245 | 241 | 248 | 242 | 250 | 251 | 252 | | 242 | 246 | 252 | 255 | 242 | 254 |
| MAGENTA 1ST ROW | 255 | 245 | 250 | 240 | 255 | 247 | 255 | 254 | 245 | 243 | 252 | | 248 | 248 | 253 | 255 | 254 | 248 |
| MAGENTA 2ND ROW | 246 | 253 | 248 | 251 | 245 | 250 | 254 | 253 | 243 | 249 | 251 | | 251 | 252 | 250 | 249 | 240 | 247 |
| MAGENTA 3RD ROW | 251 | 246 | 249 | 251 | 243 | 246 | 251 | 255 | 244 | 248 | 245 | | 253 | 252 | 241 | 248 | 248 | 253 |
| MAGENTA NTH ROW | 253 | 248 | 253 | 247 | 248 | 255 | 247 | 249 | 246 | 254 | 251 | | 251 | 246 | 254 | 249 | 246 | 247 |
| YELLOW 1ST ROW | 248 | 243 | 243 | 249 | 247 | 248 | 251 | 241 | 246 | 252 | 241 | | 255 | 254 | 251 | 245 | 249 | 251 |
| YELLOW 2ND ROW | 255 | 241 | 253 | 247 | 249 | 249 | 249 | 241 | 244 | 240 | 245 | | 244 | 240 | 246 | 255 | 241 | 243 |
| YELLOW 3RD ROW | 246 | 246 | 245 | 247 | 254 | 242 | 250 | 249 | 247 | 255 | 254 | | 243 | 244 | 249 | 251 | 246 | 241 |
| YELLOW NTH ROW | 248 | 244 | 243 | 246 | 243 | 248 | 245 | 252 | 241 | 249 | 246 | | 250 | 253 | 243 | 254 | 248 | 241 |
| BLACK 1ST ROW | 248 | 249 | 247 | 241 | 246 | 246 | 246 | 247 | 253 | 252 | 251 | | 253 | 242 | 254 | 243 | 244 | 247 |
| BLACK 2ND ROW | 251 | 252 | 247 | 241 | 244 | 246 | 246 | 248 | 246 | 246 | 242 | | 253 | 246 | 255 | 242 | 243 | 248 |
| BLACK 3RD ROW | 250 | 247 | 252 | 247 | 251 | 254 | 243 | 255 | 244 | 251 | 248 | | 244 | 245 | 245 | 242 | 255 | 248 |
| BLACK NTH ROW | 241 | 242 | 241 | 240 | 254 | 242 | 253 | 242 | 249 | 242 | 246 | | 246 | 246 | 243 | 255 | 245 | 254 |

FIG.25

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | ○ | ○ | ○ | ○ | ○ | ○ | ○ | ○ | ○ | ○ | ○ | | ○ | ○ | ○ | ○ | ○ | ○ |
| CYAN 2ND ROW | × | × | × | × | × | × | × | × | × | × | × | | × | × | × | × | × | × |
| CYAN 3RD ROW | ○ | ○ | ○ | ○ | ○ | ○ | ○ | ○ | ○ | ○ | ○ | | ○ | ○ | ○ | ○ | ○ | ○ |
| CYAN NTH ROW | ○ | ○ | ○ | ○ | ○ | ○ | ○ | ○ | ○ | ○ | ○ | | ○ | ○ | ○ | ○ | ○ | ○ |
| MAGENTA 1ST ROW | ○ | ○ | ○ | ○ | ○ | ○ | ○ | ○ | ○ | ○ | ○ | | ○ | ○ | ○ | ○ | ○ | ○ |
| MAGENTA 2ND ROW | ○ | ○ | ○ | ○ | ○ | ○ | ○ | ○ | ○ | ○ | ○ | | ○ | ○ | ○ | ○ | ○ | ○ |
| MAGENTA 3RD ROW | ○ | ○ | ○ | ○ | ○ | ○ | ○ | ○ | ○ | ○ | ○ | | ○ | ○ | ○ | ○ | ○ | ○ |
| MAGENTA NTH ROW | ○ | ○ | ○ | ○ | ○ | ○ | ○ | ○ | ○ | ○ | ○ | | ○ | ○ | ○ | ○ | ○ | ○ |
| YELLOW 1ST ROW | ○ | ○ | ○ | ○ | ○ | ○ | ○ | ○ | ○ | ○ | ○ | | ○ | ○ | ○ | ○ | ○ | ○ |
| YELLOW 2ND ROW | ○ | ○ | ○ | ○ | ○ | ○ | ○ | ○ | ○ | ○ | ○ | | ○ | ○ | ○ | ○ | ○ | ○ |
| YELLOW 3RD ROW | ○ | ○ | ○ | ○ | ○ | ○ | ○ | ○ | ○ | ○ | ○ | | ○ | ○ | ○ | ○ | ○ | ○ |
| YELLOW NTH ROW | ○ | ○ | ○ | ○ | ○ | ○ | ○ | ○ | ○ | ○ | ○ | | ○ | ○ | ○ | ○ | ○ | ○ |
| BLACK 1ST ROW | ○ | ○ | ○ | ○ | ○ | ○ | ○ | ○ | ○ | ○ | ○ | | ○ | ○ | ○ | ○ | ○ | ○ |
| BLACK 2ND ROW | ○ | ○ | ○ | ○ | ○ | ○ | ○ | ○ | ○ | ○ | ○ | | ○ | ○ | ○ | ○ | ○ | ○ |
| BLACK 3RD ROW | ○ | ○ | ○ | ○ | ○ | ○ | ○ | ○ | ○ | ○ | ○ | | ○ | ○ | ○ | ○ | ○ | ○ |
| BLACK NTH ROW | ○ | ○ | ○ | ○ | ○ | ○ | ○ | ○ | ○ | ○ | ○ | | ○ | ○ | ○ | ○ | ○ | ○ |

FIG.26

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | 255 | 255 | 255 | 255 | 255 | 255 | 255 | 255 | 255 | 255 | 255 | | 255 | 255 | 255 | 255 | 255 | 255 |
| CYAN 2ND ROW | 255 | 255 | 255 | 255 | 255 | 255 | 255 | 255 | 255 | 255 | 255 | | 255 | 255 | 255 | 255 | 255 | 255 |
| CYAN 3RD ROW | 255 | 255 | 255 | 255 | 255 | 255 | 255 | 255 | 255 | 255 | 255 | | 255 | 255 | 255 | 255 | 255 | 255 |
| CYAN NTH ROW | 255 | 255 | 255 | 255 | 255 | 255 | 255 | 255 | 255 | 255 | 255 | | 255 | 255 | 255 | 255 | 255 | 255 |
| MAGENTA 1ST ROW | 255 | 255 | 255 | 255 | 255 | 255 | 255 | 255 | 255 | 255 | 255 | | 255 | 255 | 255 | 255 | 255 | 255 |
| MAGENTA 2ND ROW | 255 | 255 | 255 | 255 | 255 | 255 | 255 | 255 | 255 | 255 | 255 | | 255 | 255 | 255 | 255 | 255 | 255 |
| MAGENTA 3RD ROW | 255 | 255 | 255 | 255 | 255 | 255 | 255 | 255 | 255 | 255 | 255 | | 255 | 255 | 255 | 255 | 255 | 255 |
| MAGENTA NTH ROW | 255 | 255 | 255 | 255 | 255 | 255 | 255 | 255 | 255 | 255 | 255 | | 255 | 255 | 255 | 255 | 255 | 255 |
| YELLOW 1ST ROW | 255 | 255 | 255 | 255 | 255 | 255 | 255 | 255 | 255 | 255 | 255 | | 255 | 255 | 255 | 255 | 255 | 255 |
| YELLOW 2ND ROW | 255 | 255 | 255 | 255 | 255 | 255 | 255 | 255 | 255 | 255 | 255 | | 255 | 255 | 255 | 255 | 255 | 255 |
| YELLOW 3RD ROW | 255 | 255 | 255 | 255 | 255 | 255 | 255 | 255 | 255 | 255 | 255 | | 255 | 255 | 255 | 255 | 255 | 255 |
| YELLOW NTH ROW | 255 | 255 | 255 | 255 | 255 | 255 | 255 | 255 | 255 | 255 | 255 | | 255 | 255 | 255 | 255 | 255 | 255 |
| BLACK 1ST ROW | 255 | 255 | 255 | 255 | 255 | 255 | 255 | 255 | 255 | 255 | 255 | | 255 | 255 | 255 | 255 | 255 | 255 |
| BLACK 2ND ROW | 255 | 255 | 255 | 255 | 255 | 255 | 255 | 255 | 255 | 255 | 255 | | 255 | 255 | 255 | 255 | 255 | 255 |
| BLACK 3RD ROW | 255 | 255 | 255 | 255 | 255 | 255 | 255 | 255 | 255 | 255 | 255 | | 255 | 255 | 255 | 255 | 255 | 255 |
| BLACK NTH ROW | 255 | 255 | 255 | 255 | 255 | 255 | 255 | 255 | 255 | 255 | 255 | | 255 | 255 | 255 | 255 | 255 | 255 |

FIG.27

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | 255 | 245 | 254 | 241 | 244 | 249 | 240 | 251 | 249 | 246 | 247 | | 250 | 128 | 253 | 247 | 251 | 253 |
| CYAN 2ND ROW | 240 | 243 | 247 | 253 | 240 | 249 | 248 | 254 | 248 | 249 | 251 | | 250 | 121 | 246 | 255 | 243 | 245 |
| CYAN 3RD ROW | 244 | 255 | 246 | 241 | 253 | 254 | 253 | 252 | 245 | 240 | 246 | | 245 | 101 | 244 | 251 | 255 | 240 |
| CYAN NTH ROW | 242 | 244 | 243 | 247 | 248 | 254 | 250 | 252 | 251 | 240 | 240 | | 245 | 133 | 243 | 255 | 248 | 246 |
| MAGENTA 1ST ROW | 249 | 250 | 242 | 253 | 252 | 250 | 248 | 244 | 241 | 245 | 244 | | 248 | 129 | 242 | 244 | 240 | 246 |
| MAGENTA 2ND ROW | 252 | 250 | 241 | 243 | 244 | 240 | 242 | 248 | 255 | 243 | 242 | | 251 | 115 | 249 | 251 | 255 | 252 |
| MAGENTA 3RD ROW | 245 | 249 | 247 | 248 | 247 | 248 | 255 | 245 | 254 | 241 | 247 | | 240 | 146 | 248 | 254 | 247 | 254 |
| MAGENTA NTH ROW | 242 | 245 | 245 | 250 | 253 | 247 | 253 | 247 | 240 | 251 | 250 | | 244 | 147 | 247 | 253 | 241 | 255 |
| YELLOW 1ST ROW | 241 | 248 | 245 | 241 | 252 | 246 | 246 | 245 | 250 | 246 | 243 | | 255 | 119 | 250 | 246 | 250 | 252 |
| YELLOW 2ND ROW | 255 | 240 | 254 | 252 | 240 | 250 | 246 | 242 | 243 | 253 | 252 | | 253 | 141 | 247 | 243 | 245 | 254 |
| YELLOW 3RD ROW | 246 | 254 | 254 | 250 | 245 | 244 | 249 | 245 | 248 | 244 | 245 | | 241 | 142 | 249 | 240 | 245 | 248 |
| YELLOW NTH ROW | 244 | 244 | 248 | 245 | 249 | 255 | 244 | 244 | 245 | 252 | 252 | | 254 | 139 | 253 | 249 | 245 | 243 |
| BLACK 1ST ROW | 246 | 254 | 253 | 255 | 252 | 252 | 244 | 247 | 248 | 246 | 247 | | 243 | 144 | 243 | 244 | 254 | 241 |
| BLACK 2ND ROW | 248 | 246 | 249 | 248 | 246 | 240 | 243 | 253 | 252 | 255 | 254 | | 240 | 122 | 253 | 242 | 250 | 241 |
| BLACK 3RD ROW | 242 | 251 | 246 | 242 | 252 | 241 | 241 | 245 | 249 | 243 | 253 | | 241 | 121 | 250 | 255 | 248 | 243 |
| BLACK NTH ROW | 253 | 249 | 248 | 252 | 248 | 249 | 242 | 255 | 252 | 253 | 246 | | 245 | 142 | 254 | 243 | 254 | 242 |

FIG.28

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | ○ | ○ | ○ | ○ | ○ | ○ | ○ | ○ | ○ | ○ | ○ | | ○ | × | ○ | ○ | ○ | ○ |
| CYAN 2ND ROW | ○ | ○ | ○ | ○ | ○ | ○ | ○ | ○ | ○ | ○ | ○ | | ○ | × | ○ | ○ | ○ | ○ |
| CYAN 3RD ROW | ○ | ○ | ○ | ○ | ○ | ○ | ○ | ○ | ○ | ○ | ○ | | ○ | × | ○ | ○ | ○ | ○ |
| CYAN NTH ROW | ○ | ○ | ○ | ○ | ○ | ○ | ○ | ○ | ○ | ○ | ○ | | ○ | × | ○ | ○ | ○ | ○ |
| MAGENTA 1ST ROW | ○ | ○ | ○ | ○ | ○ | ○ | ○ | ○ | ○ | ○ | ○ | | ○ | × | ○ | ○ | ○ | ○ |
| MAGENTA 2ND ROW | ○ | ○ | ○ | ○ | ○ | ○ | ○ | ○ | ○ | ○ | ○ | | ○ | × | ○ | ○ | ○ | ○ |
| MAGENTA 3RD ROW | ○ | ○ | ○ | ○ | ○ | ○ | ○ | ○ | ○ | ○ | ○ | | ○ | × | ○ | ○ | ○ | ○ |
| MAGENTA NTH ROW | ○ | ○ | ○ | ○ | ○ | ○ | ○ | ○ | ○ | ○ | ○ | | ○ | × | ○ | ○ | ○ | ○ |
| YELLOW 1ST ROW | ○ | ○ | ○ | ○ | ○ | ○ | ○ | ○ | ○ | ○ | ○ | | ○ | × | ○ | ○ | ○ | ○ |
| YELLOW 2ND ROW | ○ | ○ | ○ | ○ | ○ | ○ | ○ | ○ | ○ | ○ | ○ | | ○ | × | ○ | ○ | ○ | ○ |
| YELLOW 3RD ROW | ○ | ○ | ○ | ○ | ○ | ○ | ○ | ○ | ○ | ○ | ○ | | ○ | × | ○ | ○ | ○ | ○ |
| YELLOW NTH ROW | ○ | ○ | ○ | ○ | ○ | ○ | ○ | ○ | ○ | ○ | ○ | | ○ | × | ○ | ○ | ○ | ○ |
| BLACK 1ST ROW | ○ | ○ | ○ | ○ | ○ | ○ | ○ | ○ | ○ | ○ | ○ | | ○ | × | ○ | ○ | ○ | ○ |
| BLACK 2ND ROW | ○ | ○ | ○ | ○ | ○ | ○ | ○ | ○ | ○ | ○ | ○ | | ○ | × | ○ | ○ | ○ | ○ |
| BLACK 3RD ROW | ○ | ○ | ○ | ○ | ○ | ○ | ○ | ○ | ○ | ○ | ○ | | ○ | × | ○ | ○ | ○ | ○ |
| BLACK NTH ROW | ○ | ○ | ○ | ○ | ○ | ○ | ○ | ○ | ○ | ○ | ○ | | ○ | × | ○ | ○ | ○ | ○ |

FIG.29

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | 255 | 255 | 255 | 255 | 255 | 255 | 255 | 255 | 255 | 255 | 255 | | 255 | 255 | 255 | 255 | 255 | 255 |
| CYAN 2ND ROW | 255 | 255 | 255 | 255 | 255 | 255 | 255 | 255 | 255 | 255 | 255 | | 255 | 255 | 255 | 255 | 255 | 255 |
| CYAN 3RD ROW | 255 | 255 | 255 | 255 | 255 | 255 | 255 | 255 | 255 | 255 | 255 | | 255 | 255 | 255 | 255 | 255 | 255 |
| CYAN NTH ROW | 255 | 255 | 255 | 255 | 255 | 255 | 255 | 255 | 255 | 255 | 255 | | 255 | 255 | 255 | 255 | 255 | 255 |
| MAGENTA 1ST ROW | 255 | 255 | 255 | 255 | 255 | 255 | 255 | 255 | 255 | 255 | 255 | | 255 | 255 | 255 | 255 | 255 | 255 |
| MAGENTA 2ND ROW | 255 | 255 | 255 | 255 | 255 | 255 | 255 | 255 | 255 | 255 | 255 | | 255 | 255 | 255 | 255 | 255 | 255 |
| MAGENTA 3RD ROW | 255 | 255 | 255 | 255 | 255 | 255 | 255 | 255 | 255 | 255 | 255 | | 255 | 255 | 255 | 255 | 255 | 255 |
| MAGENTA NTH ROW | 255 | 255 | 255 | 255 | 255 | 255 | 255 | 255 | 255 | 255 | 255 | | 255 | 255 | 255 | 255 | 255 | 255 |
| YELLOW 1ST ROW | 255 | 255 | 255 | 255 | 255 | 255 | 255 | 255 | 255 | 255 | 255 | | 255 | 255 | 255 | 255 | 255 | 255 |
| YELLOW 2ND ROW | 255 | 255 | 255 | 255 | 255 | 255 | 255 | 255 | 255 | 255 | 255 | | 255 | 255 | 255 | 255 | 255 | 255 |
| YELLOW 3RD ROW | 255 | 255 | 255 | 255 | 255 | 255 | 255 | 255 | 255 | 255 | 255 | | 255 | 255 | 255 | 255 | 255 | 255 |
| YELLOW NTH ROW | 255 | 255 | 255 | 255 | 255 | 255 | 255 | 255 | 255 | 255 | 255 | | 255 | 255 | 255 | 255 | 255 | 255 |
| BLACK 1ST ROW | 255 | 255 | 255 | 255 | 255 | 255 | 255 | 255 | 255 | 255 | 255 | | 255 | 255 | 255 | 255 | 255 | 255 |
| BLACK 2ND ROW | 255 | 255 | 255 | 255 | 255 | 255 | 255 | 255 | 255 | 255 | 255 | | 255 | 255 | 255 | 255 | 255 | 255 |
| BLACK 3RD ROW | 255 | 255 | 255 | 255 | 255 | 255 | 255 | 255 | 255 | 255 | 255 | | 255 | 255 | 255 | 255 | 255 | 255 |
| BLACK NTH ROW | 255 | 255 | 255 | 255 | 255 | 255 | 255 | 255 | 255 | 255 | 255 | | 255 | 255 | 255 | 255 | 255 | 255 |

FIG.30

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | 249 | 253 | 240 | 249 | 248 | 254 | 241 | 242 | 255 | 243 | 254 | | 242 | 104 | 246 | 241 | 255 | 246 |
| CYAN 2ND ROW | 143 | 125 | 134 | 137 | 123 | 104 | 136 | 117 | 140 | 113 | 131 | | 147 | 115 | 102 | 111 | 117 | 127 |
| CYAN 3RD ROW | 244 | 241 | 241 | 243 | 246 | 252 | 249 | 255 | 253 | 249 | 244 | | 240 | 121 | 247 | 251 | 244 | 249 |
| CYAN NTH ROW | 249 | 246 | 253 | 253 | 248 | 247 | 253 | 250 | 252 | 240 | 240 | | 243 | 122 | 251 | 251 | 255 | 253 |
| MAGENTA 1ST ROW | 246 | 250 | 240 | 243 | 241 | 251 | 245 | 240 | 246 | 253 | 253 | | 253 | 123 | 242 | 241 | 252 | 244 |
| MAGENTA 2ND ROW | 254 | 240 | 247 | 245 | 243 | 253 | 247 | 244 | 241 | 244 | 252 | | 246 | 112 | 246 | 255 | 253 | 254 |
| MAGENTA 3RD ROW | 243 | 242 | 242 | 246 | 244 | 251 | 248 | 251 | 255 | 242 | 251 | | 245 | 142 | 241 | 247 | 252 | 253 |
| MAGENTA NTH ROW | 250 | 247 | 246 | 246 | 251 | 253 | 251 | 241 | 255 | 246 | 249 | | 241 | 100 | 243 | 248 | 243 | 240 |
| YELLOW 1ST ROW | 247 | 245 | 243 | 255 | 254 | 248 | 255 | 255 | 245 | 242 | 245 | | 240 | 147 | 255 | 241 | 243 | 251 |
| YELLOW 2ND ROW | 243 | 251 | 244 | 253 | 249 | 241 | 254 | 252 | 242 | 248 | 245 | | 242 | 135 | 249 | 255 | 255 | 252 |
| YELLOW 3RD ROW | 241 | 250 | 242 | 246 | 252 | 254 | 241 | 248 | 253 | 245 | 240 | | 254 | 104 | 240 | 248 | 253 | 252 |
| YELLOW NTH ROW | 252 | 253 | 244 | 252 | 250 | 250 | 247 | 254 | 254 | 242 | 243 | | 249 | 139 | 247 | 248 | 248 | 244 |
| BLACK 1ST ROW | 246 | 249 | 246 | 252 | 247 | 240 | 250 | 246 | 250 | 254 | 254 | | 249 | 109 | 249 | 247 | 249 | 250 |
| BLACK 2ND ROW | 253 | 255 | 253 | 250 | 255 | 254 | 251 | 252 | 255 | 255 | 244 | | 240 | 112 | 249 | 250 | 240 | 243 |
| BLACK 3RD ROW | 246 | 243 | 244 | 243 | 252 | 240 | 246 | 252 | 245 | 250 | 253 | | 246 | 111 | 249 | 243 | 240 | 247 |
| BLACK NTH ROW | 249 | 249 | 251 | 248 | 248 | 245 | 255 | 246 | 244 | 242 | 253 | | 240 | 110 | 244 | 245 | 254 | 252 |

FIG.31

| PIXEL NUMBER IN MAIN SCANNING DIRECTION | 1 | 2 | 3 | 4 | 5 | 6 | 7 | 8 | 9 | 10 | 11 | | m-5 | m-4 | m-3 | m-2 | m-1 | m |
|---|---|---|---|---|---|---|---|---|---|---|---|---|---|---|---|---|---|---|
| CYAN 1ST ROW | ○ | ○ | ○ | ○ | ○ | ○ | ○ | ○ | ○ | ○ | ○ | | ○ | × | ○ | ○ | ○ | ○ |
| CYAN 2ND ROW | × | × | × | × | × | × | × | × | × | × | × | | × | × | × | × | × | × |
| CYAN 3RD ROW | ○ | ○ | ○ | ○ | ○ | ○ | ○ | ○ | ○ | ○ | ○ | | ○ | × | ○ | ○ | ○ | ○ |
| CYAN NTH ROW | ○ | ○ | ○ | ○ | ○ | ○ | ○ | ○ | ○ | ○ | ○ | | ○ | × | ○ | ○ | ○ | ○ |
| MAGENTA 1ST ROW | ○ | ○ | ○ | ○ | ○ | ○ | ○ | ○ | ○ | ○ | ○ | | ○ | × | ○ | ○ | ○ | ○ |
| MAGENTA 2ND ROW | ○ | ○ | ○ | ○ | ○ | ○ | ○ | ○ | ○ | ○ | ○ | | ○ | × | ○ | ○ | ○ | ○ |
| MAGENTA 3RD ROW | ○ | ○ | ○ | ○ | ○ | ○ | ○ | ○ | ○ | ○ | ○ | | ○ | × | ○ | ○ | ○ | ○ |
| MAGENTA NTH ROW | ○ | ○ | ○ | ○ | ○ | ○ | ○ | ○ | ○ | ○ | ○ | | ○ | × | ○ | ○ | ○ | ○ |
| YELLOW 1ST ROW | ○ | ○ | ○ | ○ | ○ | ○ | ○ | ○ | ○ | ○ | ○ | | ○ | × | ○ | ○ | ○ | ○ |
| YELLOW 2ND ROW | ○ | ○ | ○ | ○ | ○ | ○ | ○ | ○ | ○ | ○ | ○ | | ○ | × | ○ | ○ | ○ | ○ |
| YELLOW 3RD ROW | ○ | ○ | ○ | ○ | ○ | ○ | ○ | ○ | ○ | ○ | ○ | | ○ | × | ○ | ○ | ○ | ○ |
| YELLOW NTH ROW | ○ | ○ | ○ | ○ | ○ | ○ | ○ | ○ | ○ | ○ | ○ | | ○ | × | ○ | ○ | ○ | ○ |
| BLACK 1ST ROW | ○ | ○ | ○ | ○ | ○ | ○ | ○ | ○ | ○ | ○ | ○ | | ○ | × | ○ | ○ | ○ | ○ |
| BLACK 2ND ROW | ○ | ○ | ○ | ○ | ○ | ○ | ○ | ○ | ○ | ○ | ○ | | ○ | × | ○ | ○ | ○ | ○ |
| BLACK 3RD ROW | ○ | ○ | ○ | ○ | ○ | ○ | ○ | ○ | ○ | ○ | ○ | | ○ | × | ○ | ○ | ○ | ○ |
| BLACK NTH ROW | ○ | ○ | ○ | ○ | ○ | ○ | ○ | ○ | ○ | ○ | ○ | | ○ | × | ○ | ○ | ○ | ○ |

IMAGE FORMING APPARATUS DIAGNOSING PRINT HEAD AND OPTICAL SYSTEM CONDITIONS BASED ON PRINTED TEST PATTERN

BACKGROUND OF THE INVENTION

1. Field of the Invention

The present invention relates to an image forming apparatus, and more particularly to an image forming apparatus, which is provided with an image reading device, and can diagnose conditions of nozzles in a print head and an optical system in the image reading device.

2. Description of the Related Art

There have so far been provided a method, which is used for detection of a defect in the print head by a test pattern, and for visual check of the printed test pattern to see if any defect being occurred. However, this method may have a shortcoming that the results of a visual check differ according to each person's subjective point of view. For example, nozzle clogging may be overlooked, or sometimes such a magnifying glass as a loupe is needed.

In addition, Japanese Unexamined Patent Publication, No. 9-240017 discloses an art for detecting which nozzles are defective.

However, JPP 9-240017 lacks a special diagnostic function for an optical system. That is, the production of a high-quality image will not be able to expect when a defect occurs in a scanner portion as an image reading device. Since optical systems such as a scanner are usually covered, contamination adhered to an optical system cannot be visually checked. Further, a dedicated image reading means is needed for locating a defective nozzle.

SUMMARY OF THE INVENTION

An object of the present invention is to provide an image forming apparatus, which can detect a defect in a nozzle and an optical system.

Another object of the present invention is to provide an image forming apparatus in which a user is informed of an execution of maintenance.

According to the present invention, there is provided an image forming apparatus comprising: a scanner which reads an image and a print head which prints an image; a head control unit which controls the print head to print a test pattern with the print head; and an image processing unit which diagnoses a defect in the print head and the scanner by processing data of the test pattern which is read by the scanner.

The image forming apparatus according to the present invention have the following exceptional advantages.

(i) Starting a test pattern printing operation by the head control unit, in response to power switch-on, a print start command input from a user, or a demand of a user allows a printing operation to perform in a good condition. Even if the situation where a defect in the ink jet nozzle or contamination adhered to the optical system is caused by having been left unused for a long time.

In addition, it allows image degradation to avoid in an unusual situation.

(ii) Printing a test pattern repeatedly by the head control unit, or reading it repeatedly by the scanner permits accuracy of the results of comparing processing to enhance.

In addition, determining whether a defect is occurred in the nozzle in the print head or the optical system of the scanner by the image processing unit permits a proper countermeasure to take according to where a defect occurs and what is a cause therefor.

(iii) Providing a display unit for displaying a command to clean the ink nozzle when the image processing unit determined a defect to be occurred in the ink nozzle system enables a user to prompt to input a command.

In addition, locating a defect in the ink nozzle by the image processing unit when a defect is occurred, and providing a cleaning unit for cleaning the nozzle with respect to defective portions enables the amounts of ink needed for cleaning the nozzle and time required for cleaning operation to reduce, with the minimum cleaning operation.

(iv) Providing the display unit for displaying a command to perform maintenance of the optical system when the image processing unit determined a defect to be occurred in the optical system of the scanner makes it possible to prompt a user to perform maintenance of the optical system.

In addition, locating a defect in the optical system when a defect is occurred in the optical system by the image processing unit, and providing the display unit for displaying defective portions makes it possible to reduce the time required for cleaning operation with the minimum cleaning operation.

BRIEF DESCRIPTION OF THE DRAWINGS

FIG. 18 is an example of the contents of the image data table stored in the memory;

FIG. 19 is the contents of the image data table (no defect), in which a sample of a test pattern is read;

FIG. 20 is the contents of the image data table (no defect), in which the results of an image comparing processing is stored;

FIG. 21 is a table showing the details of the self-diagnostic mode;

FIG. 23 is an example of the contents of the image data;

FIG. 24 is contents of the image data table (defect occurs), in which a sample of a test pattern is stored;

FIG. 25 is contents of the image data table (defect occurs in the nozzle), in which the results of an image comparing processing is stored;

FIG. 26 is an example of the contents of the image data table;

FIG. 27 is contents of the image data table (defect occurs in the optical system), in which a sample of a test pattern is read;

FIG. 28 is contents of the image data table (defect occurs in the optical system), in which the results of an image comparing is stored;

FIG. 29 is an example of the contents of the image data;

FIG. 30 is contents of the image data table (defect occurs both in the nozzle and the optical system), in which a sample of a test pattern is read;

FIG. 31 is contents of the image data table (defect occurs both in the nozzle and the optical system), in which the results of an image comparing processing is stored;

The details of one or more embodiments of the present invention set forth in the description and the accompanying drawings below. Other features, and advantages of the present invention will be apparent from the description, drawings, and claims.

DESCRIPTION OF THE PREFERRED EMBODIMENTS

The preferred embodiments of the present invention will be explained below with reference to the accompanying drawings.

Figure 1:
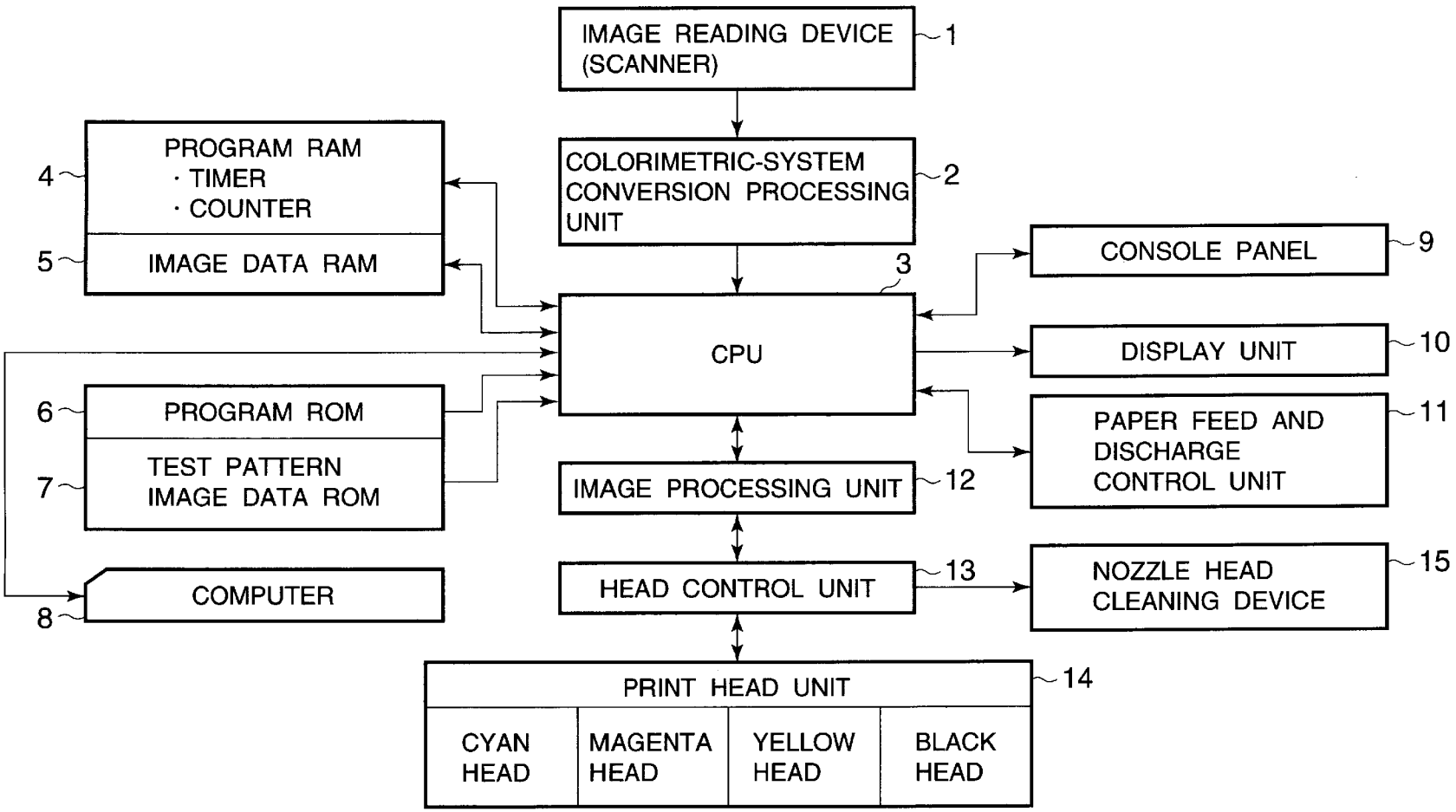
FIG. 1 is a block diagram of the entire system configuration of an embodiment of the image processing apparatus according to the present invention.

FIG. 1 is a block diagram of the entire system configuration of the processing apparatus according to an embodiment of the present invention. In FIG. 1, Reference numeral 1 denotes an image reading device (scanner), 2 denotes a colorimetric-system conversion processing unit, 3 denotes a central processing unit (CPU), 4 denotes a program RAM, 5 denotes an image data RAM, 6 denotes a program ROM, 7 denotes a test pattern image data ROM, 8 denotes a computer, 9 denotes a console panel, 10 denotes a display unit, 11 denotes a paper feed and discharge control unit, 12 denotes an image processing unit, 13 denotes a head control unit, 14 denotes a print head unit, and 15 denotes a nozzle head cleaning device.

The scanner 1 (as the image reading device) is to used for reading a reflected light from a document, placed on a document table, by a line sensor (CCD) while scanning a line of the sub scanning direction in the main scanning direction by the carriage with a light source. The CCD outputs an analog electric signal depending on the intensity of the reflected light, and the analog electric signal is converted into a digital signal by an analog-to-digital converter. Image data of one plane are output from the scanner 1 when the scanner 1 is a monochrome scanner, and image data of three (RGB) planes are output when the scanner 1 is a color scanner. Image data are output as 10, 12, or 24 bits when the scanner is a high-grade scanner.

The colorimetric-system conversion processing unit 2 converts the RGB image data to the CMYK image data to transform the data type for processing in the CPU. The CPU 3 is connected with the program RAM 4, the image data RAM 5, the program ROM 6, the test pattern image data ROM 7, the console panel 9, the display unit 10, the paper feed and discharge control unit 11, and the image processing unit 12. The CPU 3 operates in accordance with a program stored in the program ROM 6. The program RAM 4 and the image data RAM 5 are used as a work area for the CPU 3, and can store various types of system information and image data.

Respective program ROMs 6,7 store information, which must be held even if the power is turned off. Such information includes an operation program of the CPU 3, operation programs of the respective modules in the system, image data of the test pattern, and the like. The console panel 9 receives various data and supplies the input data to the CPU 3. The display unit 10 can display messages for informing a user of various conditions of the system. The paper feed and discharge control unit 11 feeds and conveys a print medium such as a sheet of paper under the control of the CPU 3.

The image processing unit 12 temporarily holds image data which are transferred from the scanner 1, based on which determines whether the image data is a character image or a picture image. Then, the image data is subjected to filtering, resolution conversion and halftone processing. In addition, the self-diagnostic processing is also performed in the image processing unit 12. The head control unit 13 processes the image data transferred from the image processing unit 12 so that the processed image data can be handled by the print head unit 14, and controls the carriage. The print head unit 14 jets out ink of the respective colors from a plurality of nozzles of ink heads onto a print medium in accordance with information supplied from the head control unit 13 to print an image on the print medium. The nozzle head cleaning device 15 cleans the nozzles when a defect occurs in the nozzles.

Figure 2:
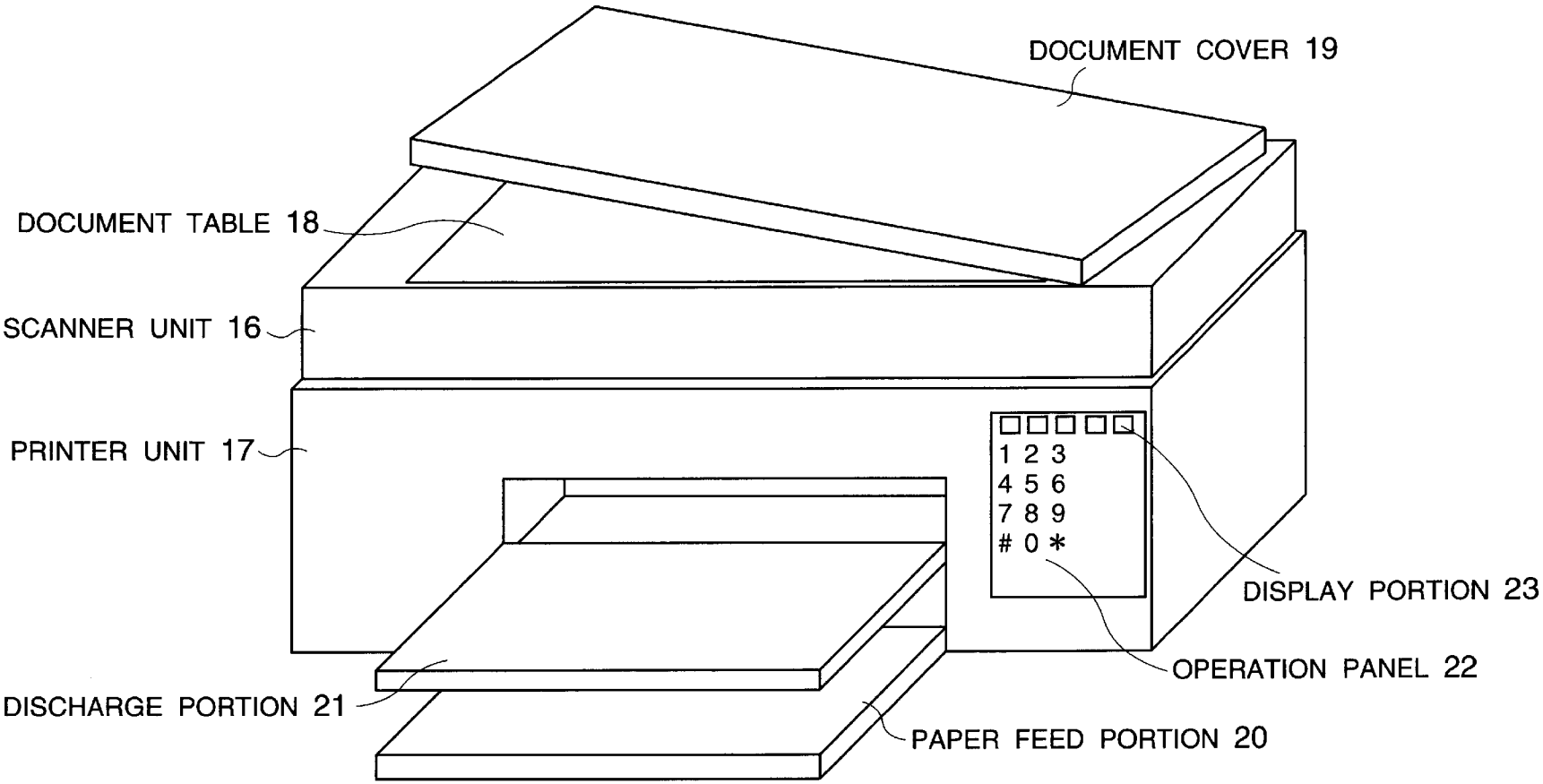
FIG. 2 is a perspective view of the image forming apparatus.

FIG. 2 is a perspective view of the image forming apparatus. The image forming apparatus of FIG. 2 is comprised of a scanner unit 16 and a printer unit 17. The scanner unit 16 comprises a document table 18 on which a document is placed, and a document cover 19 which covers the document so that light does not shine through the cover. The printer unit 17 comprises a paper feed portion 20 on which print media are placed, a discharge portion 21 which can discharge a print medium after completing a printing operation, an operation panel 22 with which user can input a command instructing the overall units, and a display portion 23.

Figure 3:
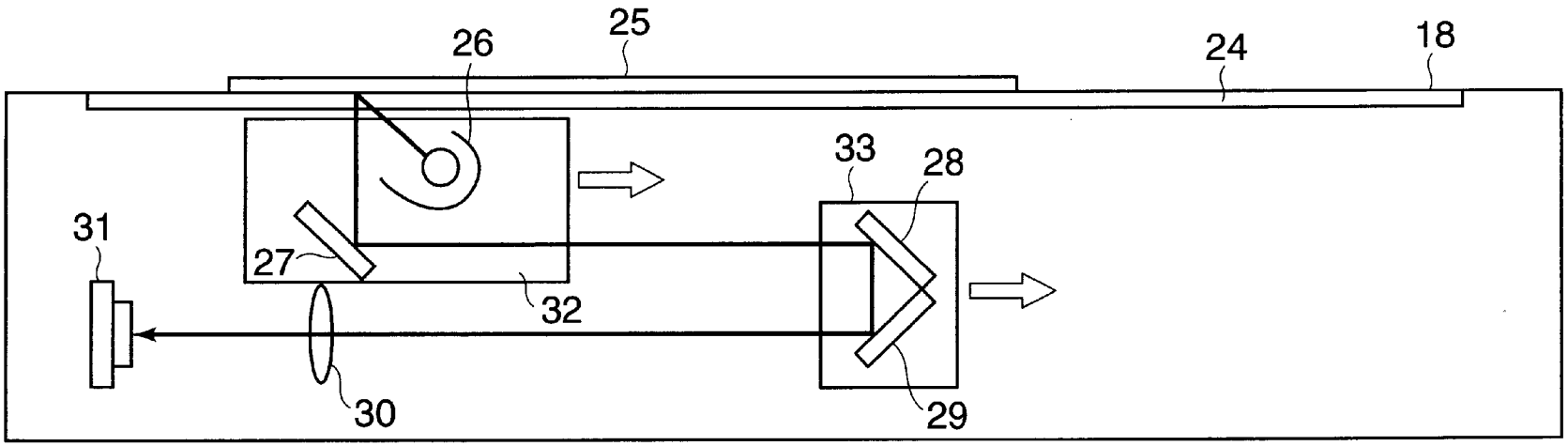
FIG. 3 is an internal configuration of an mirror-moving type scanner.

FIG. 3 is an internal configuration of the mirror-moving type scanner. The scanner unit 16 shown in FIG. 3 is the mirror-moving type scanner with a document table fixed. In FIG. 3, a first and second carriages 32 and 33 are provided thereto, a lamp 26 and a first mirror 27 are mounted on the first carriage 32, and a second and third mirrors 28 and 29 are mounted on the second carriage 33. The platen glass 24 is a transparent colorless glass plate on which a document 25 is placed. The method of reading an image involves turning-on of a lamp (as an illumination source), illumination of the document, and reflection of the light of wavelengths corresponding to a color of the illuminated portion of the document. The reflected light is further reflected by the first, second, and third mirrors 27, 28, 29, and is incident to the line sensor through an image forming lens 30. The incident light is then converted into an electric signal corresponding to the intensity of the incident light. When the scanner unit 16 is a color scanner, the line sensor 31 generates electric signals every red, green, and blue components.

The advantages of the scanner shown in FIG. 3 include the first and second carriages that are lightweight, and can be moved at high speed. Therefore, the scanner shown in FIG. 3 is currently used in the middle- and high-speed scanners. While the disadvantages thereof include the size of the scanner may become larger, and the image may be blurred due to vibration caused by the movement of the mirrors.

Figure 4:
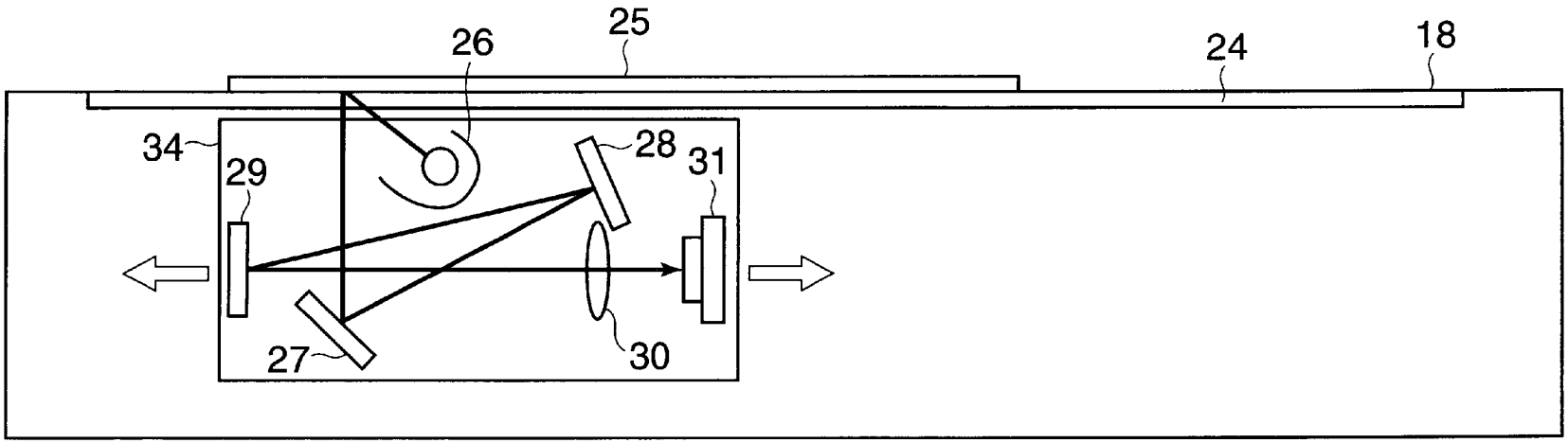
FIG. 4 is an internal configuration of carriage-integrated type scanner.

FIG. 4 is an internal configuration of the carriage-integrated type scanner. The scanner unit 16 shown in FIG. 4, only one carriage 34 is provided, and all of the lamp 26, the first, second, and third mirrors 27, 28, 29, and the line sensor 31 are mounted on the carriage 34.

The scanner shown in FIG. 4 becomes possible to reduce its size entirely. The advantages thereof include vibration caused by the movement of the carriage does not affect the image so much. While there is some problems that dissipation of heat generated by the lamp, and that carriage is so relatively larger that it is hard to move the carriage at high speed. Therefore, the scanner shown in FIG. 4 is currently used in only low-speed copiers. Nevertheless, both of the configurations of the present invention in FIGS. 3 and 4 are applicable to the scanner unit 16 in the image forming apparatus.

Figure 5:
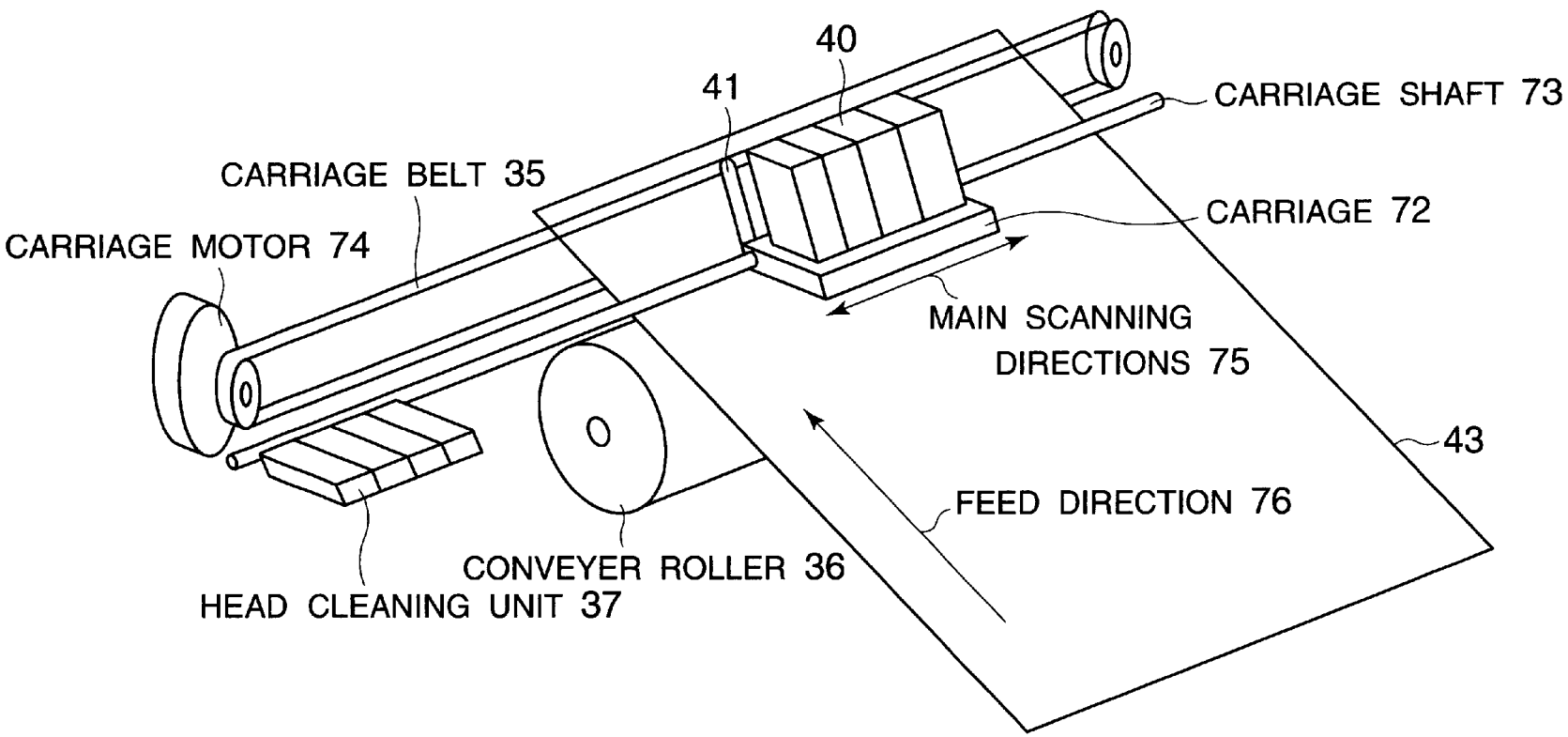
FIG. 5 is the units arranged around the scanner.

FIG. 5 is the units arranged around the scanner. As shown in FIG. 5, a set of cartridges 40 composed of an ink head 38 and an ink tank 39 for the respective colors is mounted on the carriage 72. The carriage 72 is guided, with a distance between a set of cartridges 40 and the print medium 43 kept constant, by a carriage shaft 73. The print medium 43 is fixed to the carriage belt 35 with a fixture 41 so as to be moved in the arrow (main scanning) direction. The conveyer roller 36 conveys the print medium 43 in the feed direction 76, and the head cleaning unit 37 cleans head nozzles 42.

Figure 6:
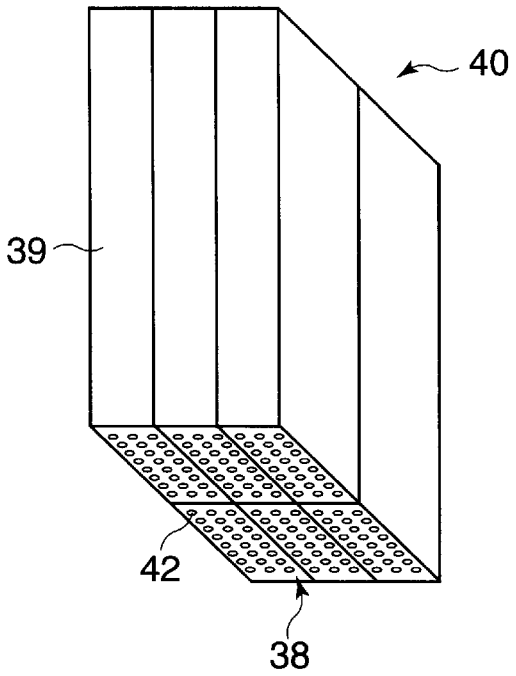
FIG. 6 is a perspective view of the ink heads.

FIG. 6 is a perspective view of the ink heads. As shown in FIG. 6, a set of cartridges 40 is comprised of a plurality of cartridges provided for the respective colors. In each cartridge, a plurality of ink nozzles and at least one ink tank are integrated with each other.

The printing operation is performed as follows.

When a document 25 is placed on the paper feed portion 20, the printer portion 17 receives a request from the computer or the like to print image information. Alternatively, when a document 25 is placed on the platen glass 24, and a copy button on the console panel 22 is pushed by a user, a sheet of paper is conveyed from the paper feed portion 20 to a printing portion. The printing portion is constituted of the carriage 72 and the carriage shaft 73, which facilitates a smooth scanning movement of the carriage 72. When a sheet of paper is conveyed to the printing portion, ink is jetted out from the ink heads 38 onto a sheet of paper. In this case, ink is selected according to what sort of image will print. During the printing operations, the sheet of paper dwells at the position. When the scanning operations of a line (one direction) are completed, a sheet of paper is fed. The distance of feeding a paper corresponds to that of a plurality of nozzles of the ink head 38. By repeating the above operation according to the image, the whole image can be printed on the sheet of paper. When the printing operation of the whole image is completed, a sheet of paper is discharged to the discharge portion 21 to be supplied to a user.

Figure 7:
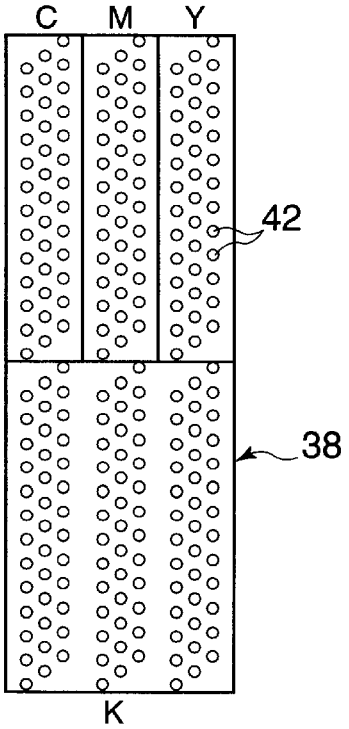
FIG. 7 is a bottom end view of the ink heads.

FIG. 7 is a bottom end view of the ink heads 38. As shown in FIG. 7, the ink heads 38 are provided for cyan (C), magenta (M), yellow (Y), and black (K) ink, and each ink head has a plurality of ink nozzles 42. Each nozzle has a diameter of tens of micrometers, and is formed with hyper-fine processing.

Figure 8:
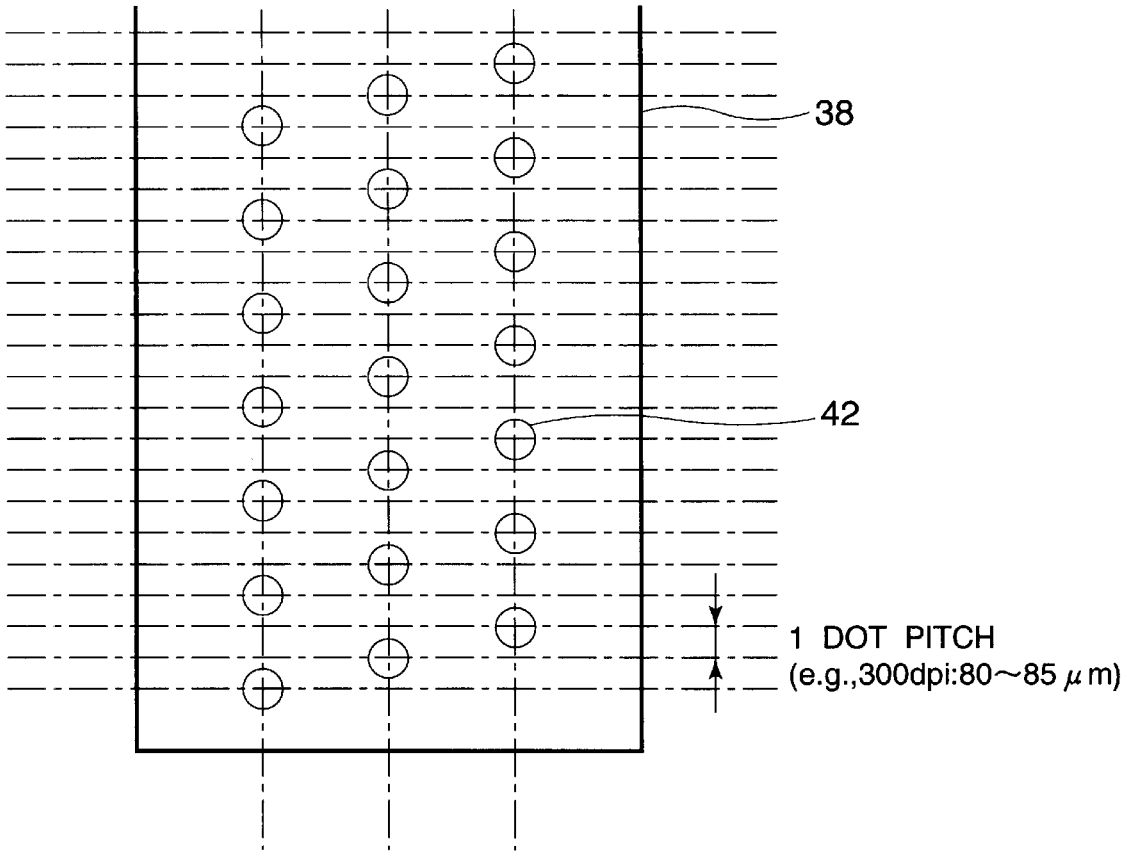
FIG. 8 is an enlarged bottom end view of the ink heads.

FIG. 8 is an enlarged bottom end view of the ink heads 38. The conditions of the head nozzles 42 more seriously affect the quality of the image than other units in producing an image. For example, Occurrence of nozzle clogging will directly lead to an image degradation. In addition, Ink technology is also essential for an ink jet printer. The reliability of the hardware greatly depends on the ink. Thus, the quality of the ink contributes to that of the printed image. Ink is composed of a number of chemical substances such as dyes as colorants, wetting agents for preventing deposition of solid contents or drying of the ink, additive agents for adjusting the PH value and other characteristics, and penetrating agents.

Figure 9:
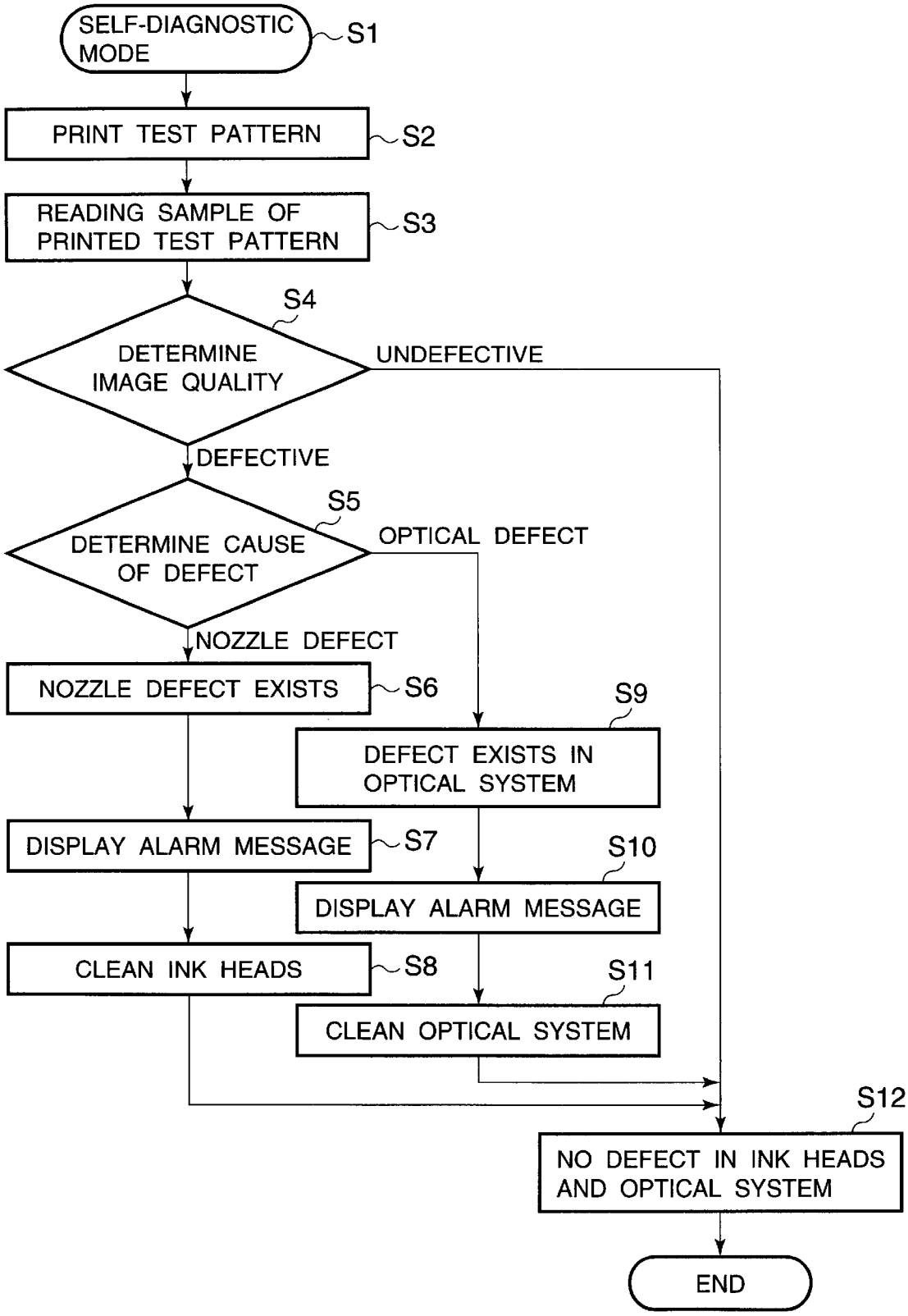
FIG. 9 is a flowchart indicating an operation sequence of the self-diagnosis mode.

FIG. 9 is a flowchart indicating an operation sequence of the self-diagnostic mode, where the operation in the self-diagnostic mode is performed for diagnosing the conditions of the nozzles in the ink heads and the optical system.

In step S1, the operation enters the self-diagnostic mode. In step S2, the CPU 3 loads, in the work area, image data of a test pattern for the self-diagnostic operation, which is stored in the test pattern image data ROM 7, and transfers the image data to the image processing unit 12. The image processing unit 12 transfers the image data of the test pattern to the head control unit 13, and the head control unit 13 further transfers the image data of the test pattern to the print head unit 14 to print the test pattern.

Figure 10:
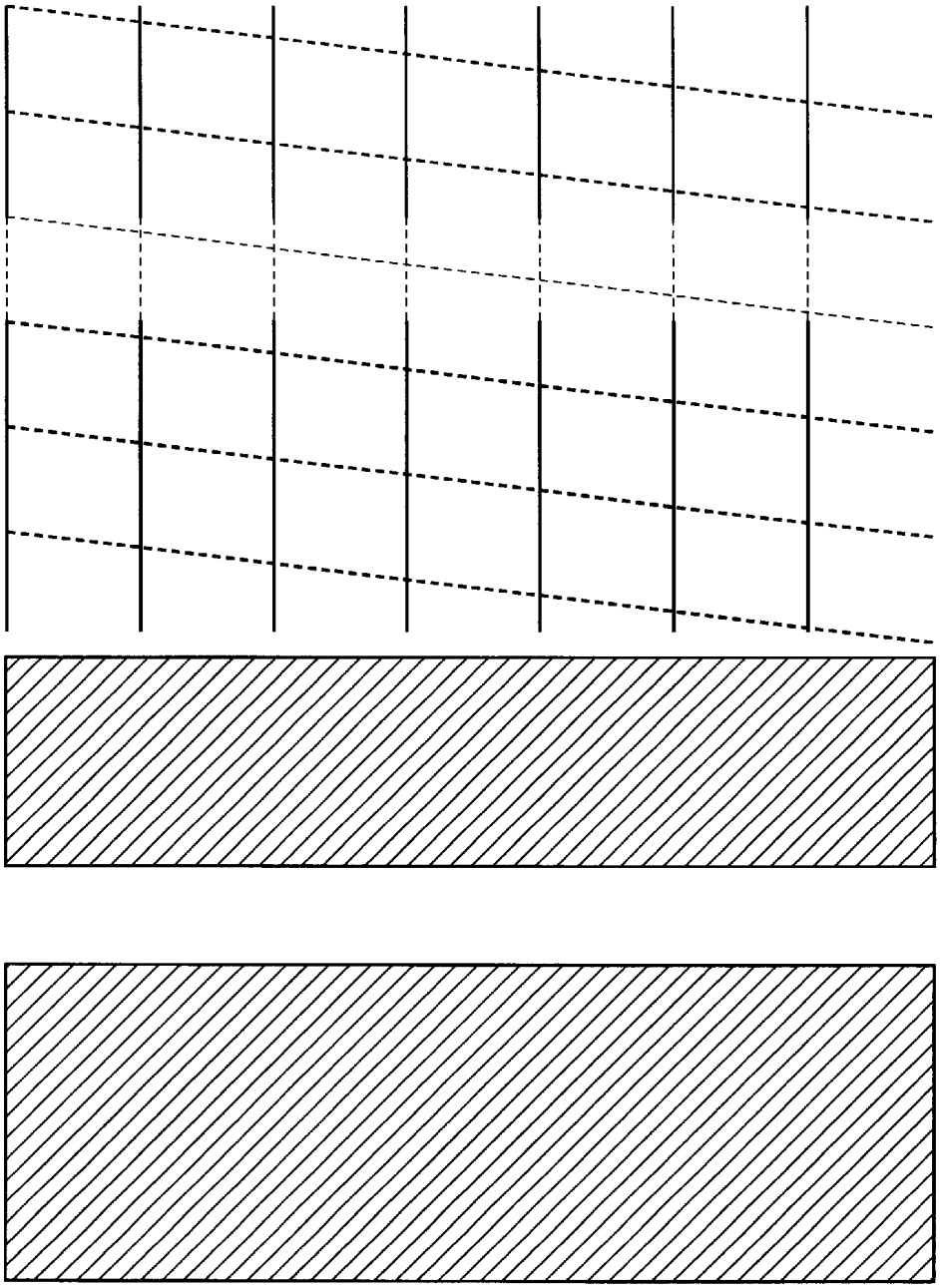
FIG. 10 is a sample of a printed test pattern.

FIG. 10 is a sample of the printed test pattern. In FIG. 10, it is assumed to print with ink of four colors, cyan (C), magenta (M), yellow (Y), and black (K).

In step S3, a sample of the printed test pattern is read by the scanner 1. Then, the image data of the test pattern read by the scanner 1 are converted into cyan, magenta, yellow, and black (CMYK), by the colorimetric-system conversion processing unit 2. Cyan, magenta, yellow, and black (CMYK) are transferred through the CPU 3 to the image processing unit 12.

In step S4, the image processing unit 12 compares the image data value with a predetermined threshold. When the image data of all the pixels are greater than the threshold, it is determined that the quality of the image value is good when the image data of the pixel is greater than the threshold. It is determined in step S12 that the quality of the image is good at every pixel, and no defect occurs in the nozzles or the optical system. Then, the operation of FIG. 9 is completed. When the image data of at least one pixel is not greater than the threshold, it is determined that the quality of the image is not good, and the operation goes to step S5. In step S5, it is determined where a defect exists in the nozzles or in the optical system. When a defect exists in the nozzles, an alarm message is displayed on the display unit 10 in step S7, and the ink heads 38 are cleaned in step S8. When a defect exists in the optical system, an alarm message is displayed on the display unit 10 in step S10, and the optical system is cleaned in step S11. After the operations in steps S8 and S11, the operation goes to step S12.

Figure 11:
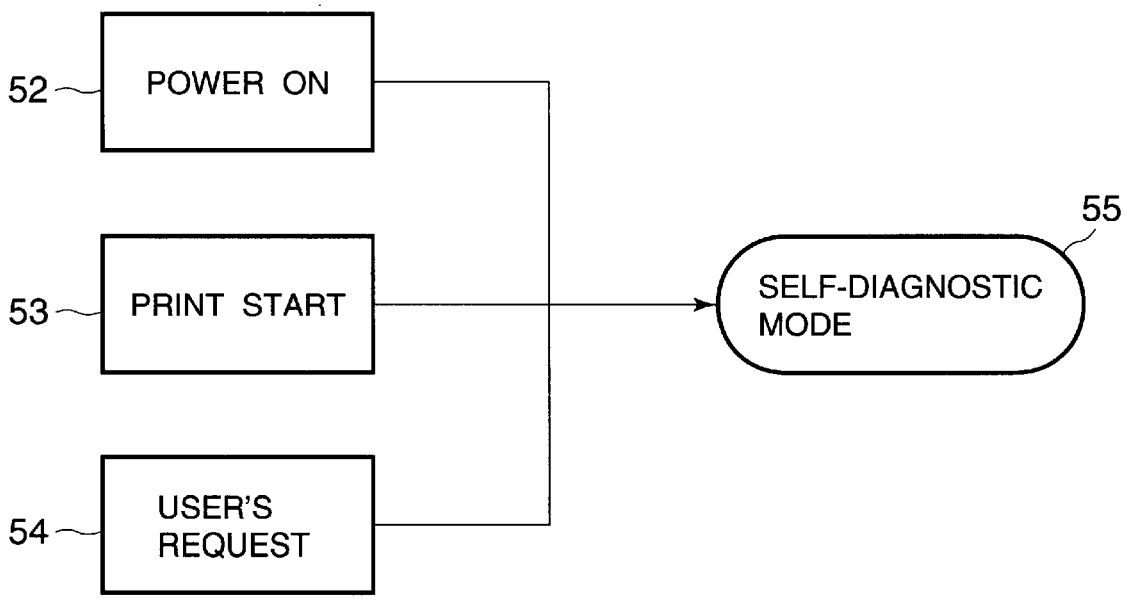
FIG. 11 is a diagram showing the conditions for entering the self-diagnostic mode.

FIG. 11 is a diagram showing the conditions for entering the self-diagnostic mode. That is, when the power is turned on (Condition 52), or when the printing operation is started (Condition 53), or when a user inputs a command to diagnose the image forming apparatus (Condition 54), the operation enters the self-diagnostic mode.

Figure 12:
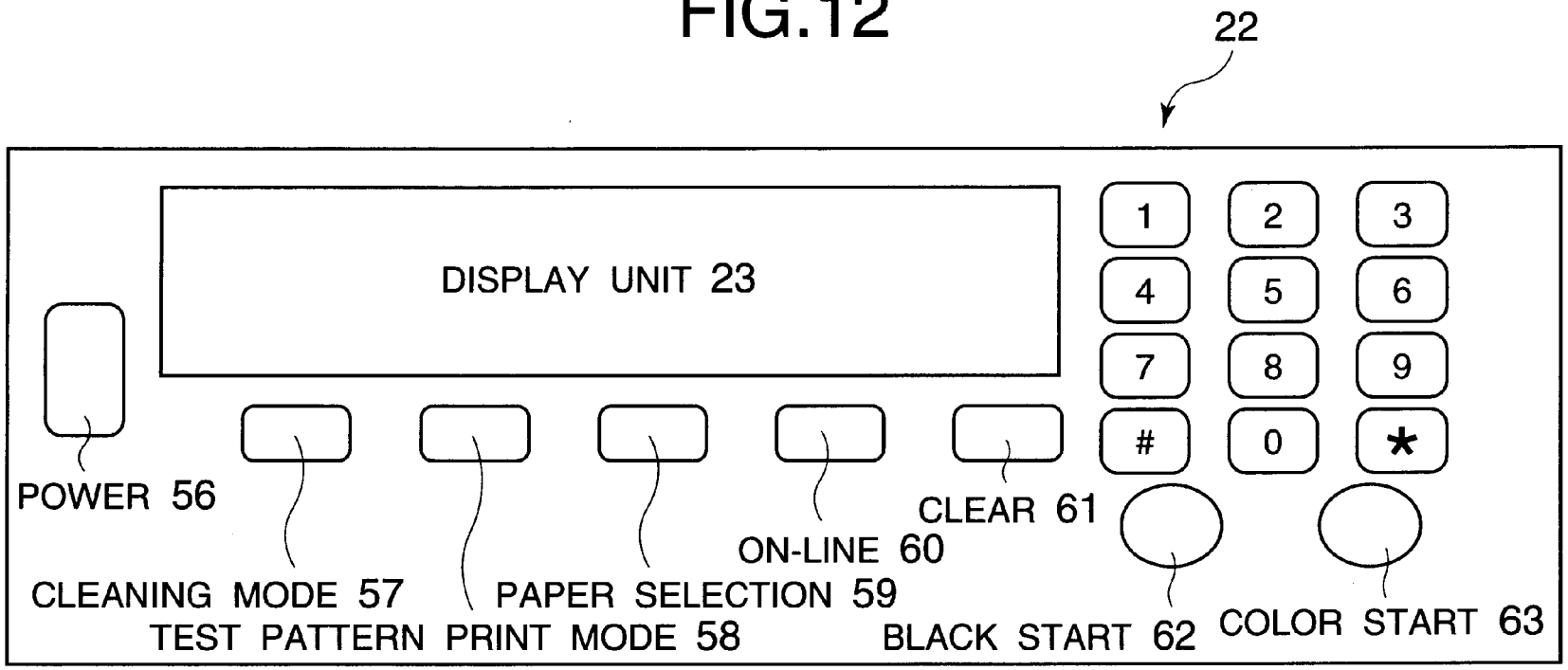
FIG. 12 is an appearance of the console panel and the display.

FIG. 12 is an appearance of the console panel 22 and the display. The image forming apparatus is designed to enter the self-diagnostic mode when pushing the "power" button 56 on the control panel 22 (Condition 52 in FIG. 11), under the control of a program stored in the program ROM 6. This makes it possible to proceed a printing operation in a good condition, even in the situation in which a defect in the nozzle or contamination adhered to the optical system is caused by having been left unused for a long time. Consequently, it always ensures generation of high-quality print sample.

Alternatively, when the "black print start" button 62 or the "color print start" button 63 on the console panel 22 is pushed by a user, or the image forming apparatus receives a print command from the computer 8 (Condition 53 in FIG. 11). This makes it possible to proceed a printing operation in a good condition, even in the situation in which a defect in the ink nozzle system or contamination adhered to the optical system is caused by having been left unused for a long time. Consequently, it always ensures generation of high-quality print sample.

Besides above, when the "test pattern print mode" button 58 on the console panel 22 is pushed by a user (Condition 54 in FIG. 11), the image forming apparatus can enter the self-diagnostic mode under the control of a program, which is stored in the program ROM 6. This makes it possible to prevent from the image degradation. Consequently, it always ensures generation of high-quality print sample.

In addition, a cleaning operation of the nozzles and the optical system can be started by pushing the "cleaning mode" button 57 on the console panel 22.

When the image forming apparatus enters the self-diagnostic mode, and the moment one of the conditions shown in FIG. 11 is met under the control of a program stored in the program ROM 6. The program causes the test pattern printed by transferring the image data from the image processing unit 12 to the print head unit 14 through the head control unit 13. The test pattern is made such that different dots are printed with jets starting from the successive nozzles of a single color in order from the top nozzle, in each of the cyan, magenta, yellow, and black cartridges. FIG. 10 is a sample of the printed test pattern. Therefore, it becomes possible to locate easily which nozzles are clogging, whether an optical defect is occurred, and where its defective portion, exist by reading the printed test pattern.

Figure 13:
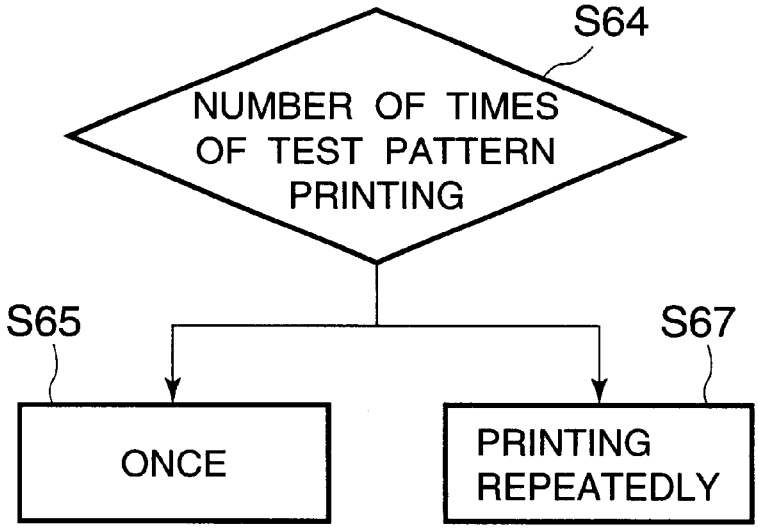
FIG. 13 is a flowchart indicating a selection of the number of times of the test pattern printing operation.
Figure 14:
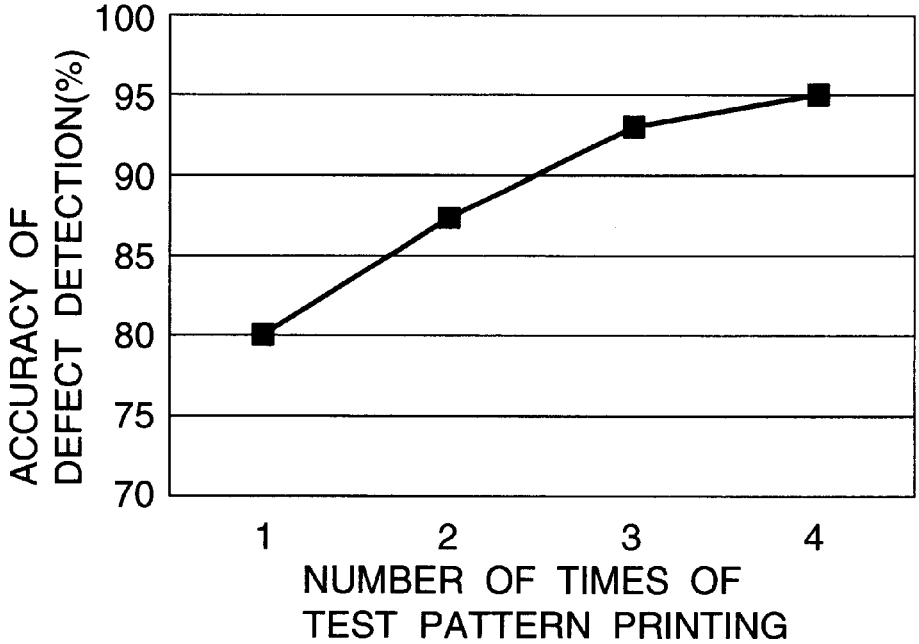
FIG. 14 is a graph showing a relationship between the number of times of a test pattern printing operation and accuracy of the detection of a defect in the nozzle.

However, the above printed test pattern does not always represent the current state of the apparatus exactly. Accordingly, as shown in FIG. 13, the number of times of the test pattern printing is divided into two cases where a test pattern is printed once (step S65) or repeatedly (step S67). FIG. 13 is a selection of the number of times of the test pattern printing operation. From FIG. 14, it is shown that a repeated operation improves accuracy of the detection of a defect when comparing the both cases where the test pattern is printed once or repeatedly.

Conventionally, location of the nozzle clogging is examined through a visual check on the printed test pattern by a user. However, according to the present invention the printed test pattern is read by the scanner, and a defect in the nozzles and the optical system is detected based on the results of the processed image data of the test pattern.

A signal of the image data of the test pattern read by the scanner 1 are comprised of red, green, and blue components. To correct the uneven characteristic of line sensors 31 disposed in line in the main scanning direction and that of the distribution characteristic of the light emitted from the illumination lamp 26, a shading correction is inevitable. Then, the shading corrected image data are transferred to the image processing system, and the image date are converted from RGB to CMYK, by the colorimetric-system conversion processing unit 2.

The resolution of the dot diameter of one pixel is about 80 to 85 $\mu$m when the 300 dpi scanner is used, and is about 40 to 45 $\mu$m when 800 dpi scanner is used. There is no problem when the ink nozzle has a resolution of 300 dpi, and it is equal to that of the scanner. Otherwise, a resolution conversion processing will have to be performed for making both resolutions identical. For example, when the resolution of the scanner is 600 dpi, and the resolution of the ink nozzles is 300 dpi, an average of adjacent two pixels is obtained to convert them to data of a pixel. In this case, the diagnosis of the scanner is performed for two adjacent pixels. That is, when a defect is detected, the image forming apparatus can recognize that a defect occurs at least in either of the adjacent two pixels. It is preferable to make a resolution of the scanner is equal to or greater than that of the ink nozzles. If a resolution of the scanner is smaller than that of the ink nozzles, there will be a possibility that ability to read only a half within one printed data may result in failure to recognize it as a pixel, or recognize two dots as a pixel. In consequence, misjudgment may be made in locating an image degradation.

Figure 15:
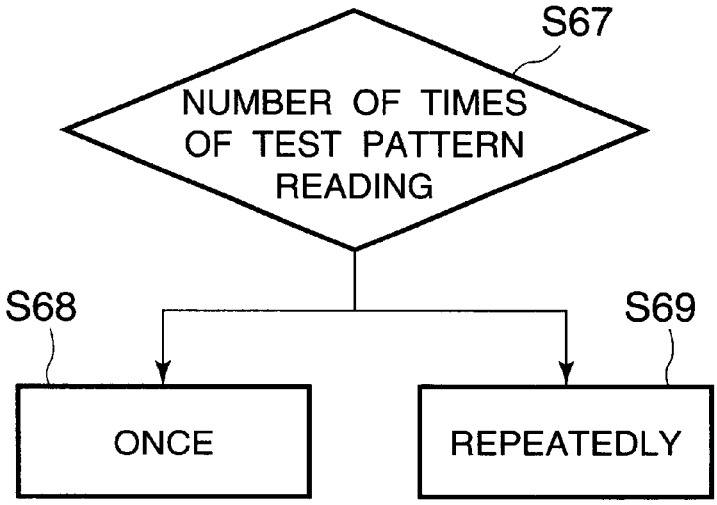
FIG. 15 is a flowchart indicating a selection of the number of times of a test pattern reading operation.
Figure 16:
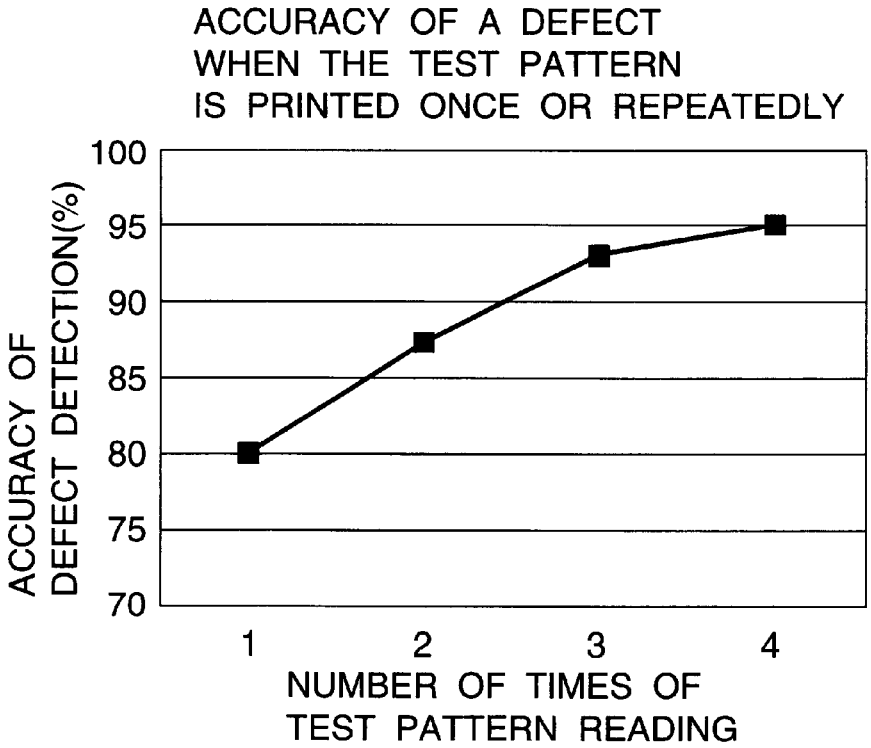
FIG. 16 is a graph showing a relationship between the number of times of a test pattern reading operation and accuracy of the detection of a defect in the nozzle.

As described before, each RGB image data is converted, in proportion to the quantity of light incident to the line sensor 31, to electrical signals in the scanner 1. The image data of the test pattern read by the scanner 1 is subjected to a shading correction and the data is converted from RGB to CMYK in the colorimetric-system processing unit 2. Consequently, the processed data may slightly vary due to an error in the system. Therefore, to correct such an error, the number of times of the test pattern reading is divided into two cases where the test pattern is printed once (step 68) or repeatedly (step 69) as shown in FIG. 15. FIG. 16 is a graph showing a relationship between the number of times of the test pattern reading operation and accuracy of the detection of a defect in the nozzle. From FIG. 16, it is shown that a repeated printing operation improves accuracy of the detection of a defect when comparing the both cases where the test pattern is printed once and repeatedly.

Figure 17:
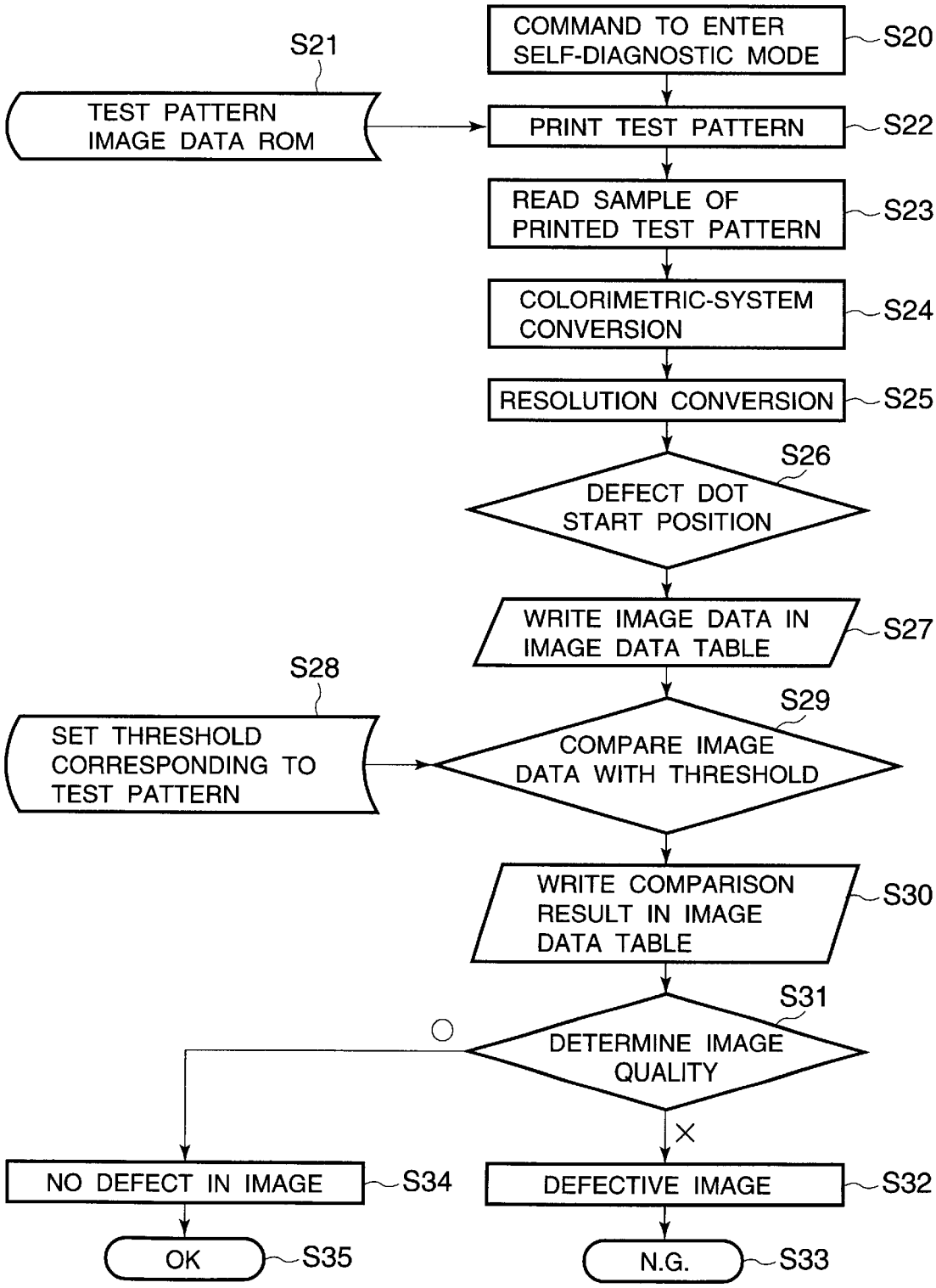
FIG. 17 is a detailed flowchart indicating an image comparing processing in the self-diagnostic mode.

FIG. 17 is a detailed flowchart indicating an image comparing processing in the self-diagnostic mode. FIGS. 18 to 20 are an example of the contents dedicated to the operation of FIG. 17. FIG. 18 is an example of the contents of the image data table stored in the memory, in which the maximum value of 255 is being stored in advance. FIG. 19 is the contents of the image data table, in which a sample of a test pattern is read. FIG. 20 is the contents of the image data table (no defect), in which the results of an image comparing processing is stored. In the examples of FIGS. 18 to 20, the number of nozzles for cyan, magenta, yellow, and black is set to n, and the resolution of the nozzle is set to 300 dpi.

In step S20 of FIG. 17, the image forming apparatus receives a command to enter the self-diagnostic mode. A test pattern is read out from the test pattern image data ROM 7 in step S21, and printed on a print medium in step S22. Thereafter, the printed test pattern is read by the scanner 1 in step S23, the image data read is subjected to a colorimetric-system conversion processing in the image processing system in step S24. In step S25, the processed data is then subjected to a resolution conversion to make the resolution of the nozzle identical. However, when the scanner 1 of the same resolution as that of the nozzles, a resolution conversion is unnecessary. In step S26, the starting position of the printed test pattern, i.e., the position of the dot printed by the nozzle No. 1, is detected. Then, in step S27, the image data that is subjected to various processing is written in the image data table. The table has the size of m×n, where m is the number of pixels in the main scanning direction and n is that in the sub scanning direction (the number of nozzle for each color is equal to that of lines) as shown in FIG. 19.

After that, the input data is compared in step s29 with a predetermined threshold that is stored in step S28 in advance. A blank circle is written in the image data table when a value of pixels of the image is greater than the threshold. Otherwise, a cross is written. In step S31, it is determined for all pixels whether or not an image degradation occurred based on the above comparison results. When a cross is detected, it is recognized in step S32 that there is a defect, and the operation goes to step S33 for performing N.G. (no good) processing. Otherwise, it is recognized in step S34 that there is no defect, and the operation goes to step S35 to complete the operation of FIG. 17.

Figure 22:
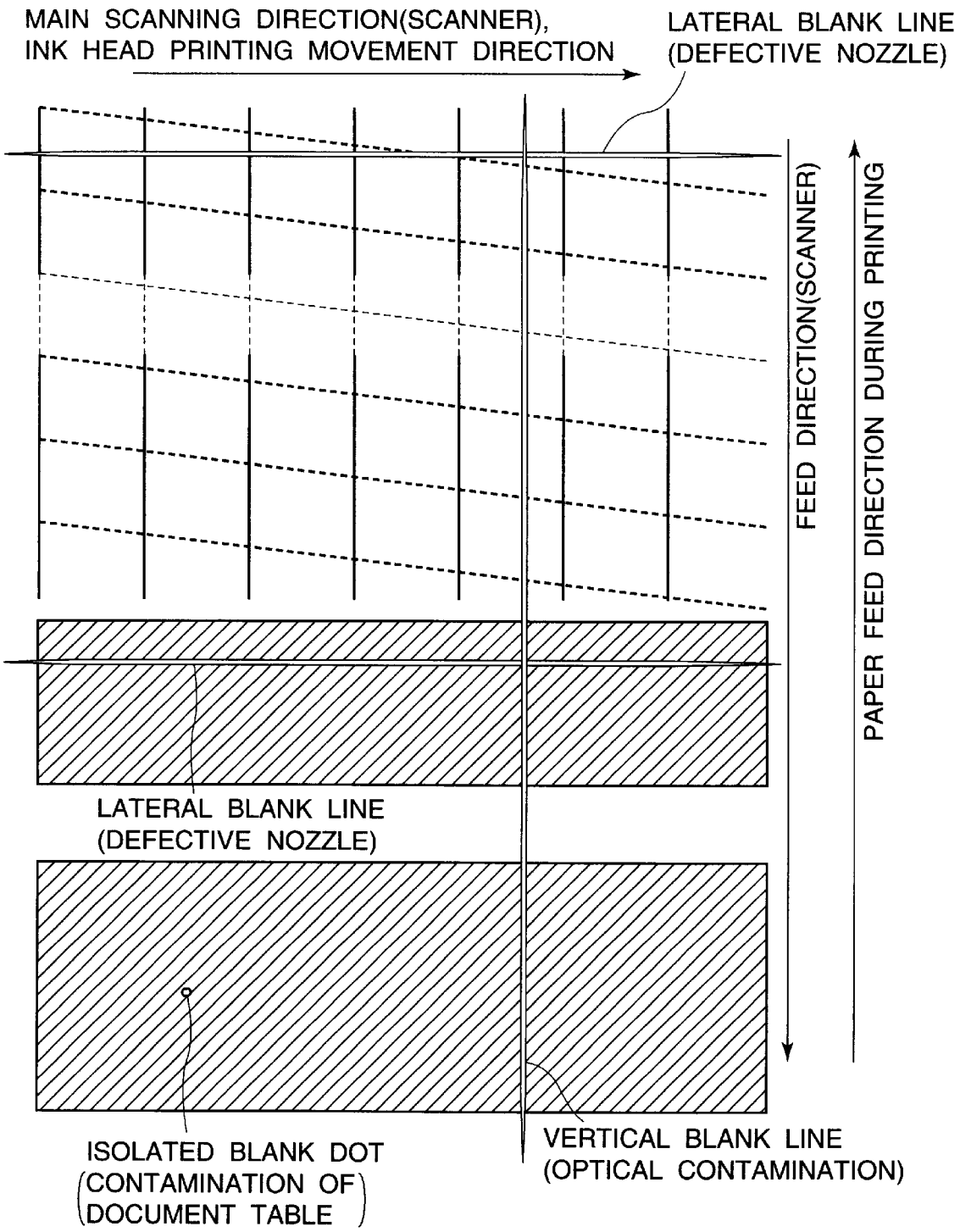
FIG. 22 is a sample of a printed test pattern when a defect exists.

FIG. 21 is a table showing the details of the self-diagnostic mode. In FIG. 21, items are classified into four possible cases based on whether a defect exists, and where it exists. In case of no defect both in the nozzle and the optical system is shown in FIGS. 18, which corresponds to the case No.1 of FIG. 2. The results, as shown in FIG. 20, show that there is no defect since the image data table contains a blank circle for all pixels. In case of a defect only in the ink nozzle is shown in FIGS. 23 to 25, which correspond to the case No. 2 of FIG. 21. Printed and read samples are shown in FIG. 22. A defect can be determined to be occurred in the nozzle when a lateral blank line is observed in FIG. 22. The results, when such an image degradation is occurred shows, as shown in FIG. 22, that a defect in the nozzle is occurred since the contents of the image data table contain a cross over a line in the sub scanning direction. In case of a defect only in the optical system is shown in FIGS. 26 to 28, which correspond to the case No. 3 of FIG. 21. In case of defect in both the ink nozzle and the optical system, which correspond to case No. 4 of FIG. 21. The results of the image data table shows, as shown in FIG. 31, that a defect is occurred both in the nozzle and the optical system since all the contents of a line in the sub scanning direction and at an pixel contain a cross in the main scanning direction.

As described above, it is possible to determine whether a defect occurs in the ink nozzle system, or the optical system, or both of them, by extracting a cross from the image data table containing the results of comparison.

When it is determined that a defect occurs in the ink nozzle, the CPU 3 can display a message prompting a user to input a command to clean the nozzles, by the display portion 23 as shown in FIGS. 2 and 12.

Figure 32:
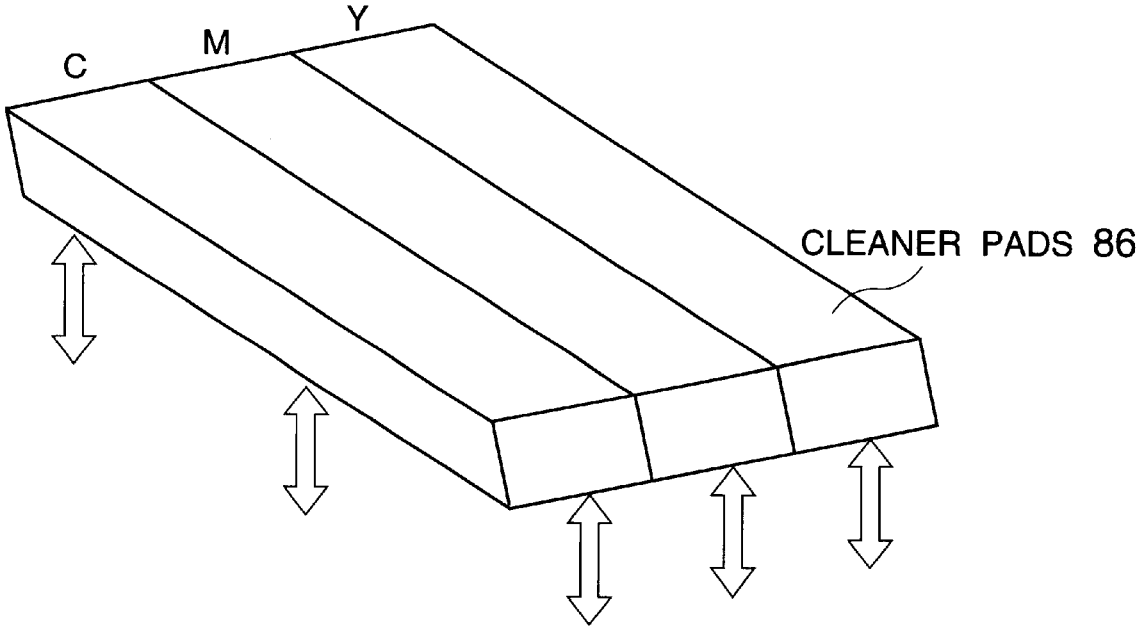
FIG. 32 is a perspective view of a cleaning mechanism in the ink head.

When a user is prompted to input a command by the above message, pushing the "cleaning mode" button 57 on the console panel 22 to start a cleaning operation of the nozzles. When the CPU 3 sends to the head control unit 13 a command to clean the nozzles, the head control unit 13 causes a movement of the carriage 72 shown in FIG. 5 from its home position to the head cleaning unit 37 for cleaning the nozzles. An ink head cleaning mechanism has a cleaner pads 86 for every cyan, magenta, and yellow, as shown in FIG. 32. The cleaner pads 86 are normally in a low position, and moves to a high position when cleaning the nozzles. The cleaner pads 86 returns to its original position When the cleaning operation is completed. The carriage 72 also returns to the home position.

In the aforementioned case No. 2 of FIG. 21, in which a nozzle defect occurs. It is possible to locate a defect in the second cyan nozzle by extracting a cross from the image data table as shown in FIG. 25 since all the contents of the second line of the cyan nozzle contain a cross.

Alternatively, when it is determined that a defect occurs in the ink nozzle based on the results of comparison, the CPU 3 sends a command to clean the nozzles to the head control unit 13. As a consequence, the cleaning operation of the ink nozzles can be performed automatically by the nozzle head cleaning device 15. That is, a user can be relieved from the bothersome operations of watching the display unit 23, determining whether or not the nozzles should be cleaned, and pushing the "cleaning mode" button 57.

When it is determined that a defect occurs in the optical system, the CPU 3 can display a message prompting a user to clean the optical system, by the display portion 23 as shown in FIGS. 2 and 12.

In the aforementioned case No. 3 of FIG. 21 of, in which a defect occurs in the optical system, it is possible to locate a defect in the optical system by extracting a cross from the image data table as shown in FIG. 28. For example, when all the contents in the column corresponding to the (m−4)—th pixel, which is positioned counting from a scanning start position, contain a cross as shown in FIG. 28, a defect can be determined to be existed in the position of the (m−4)—th pixel. The location of the defect in the optical system is displayed via a defect portion display unit (e.g., display unit 10).

Figure 33:
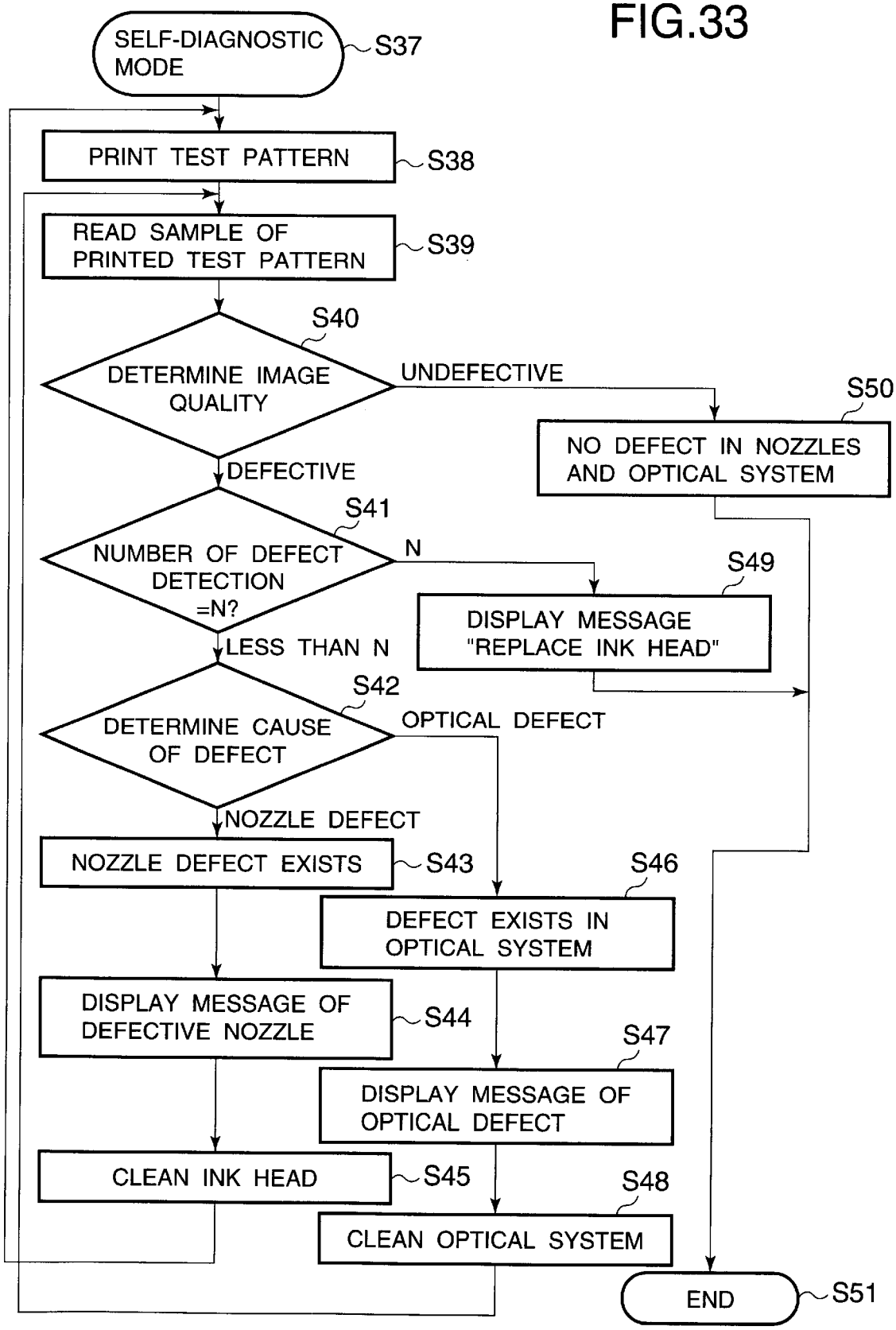
FIG. 33 is a flowchart indicating an operation in the self-diagnostic mode (performs n times).

FIG. 33 is a flowchart indicating an operation in the self-diagnosis mode (performs n times). The operations in steps S37 to S40 correspond to those in steps S1 to S4 of FIG. 9. When it is determined in step S40 that a defect exists, the operation goes to step S41. In step S41, the CPU 3 counts the number of defects. When the number of defects is greater than a predetermined number n in step S41, it is determined that the defect in the ink nozzle is resulted from deposit of ink burn at a heater, or another defect which impossible to correct by a cleaning operation. Therefore, in step S49, the CPU 3 displays on the display unit 23 a message prompting to replace the ink heads with new ones, and the operation of FIG. 33 is completed.

The nozzles cleaning operation is performed for removing the nozzle clogging. However, when performing a cleaning operation wastes a great amount of and costly ink, which should originally be used for printing operation. Although the amounts of ink used in printing a test pattern varies with a page margin, the amounts of ink used in the cleaning operation is almost the same as that of ink used in printing a test pattern on an A4 sheet. To avoid such a waste, nozzle cleaning operations can be substantially counted by a counter, thus preventing from the unnecessary repeated nozzle cleaning.

On the other hand, maintenance of the optical system is carried out by a user. Spending the amounts of times and repeating works leads to waste of labor. To avoid such a unnecessary repeated cleaning operations of the optical system, optical system cleaning operations can be counted by a counter, thus preventing from the unnecessary repeated optical system cleaning.

When it is determined in step S41 that the number of count is greater than the predetermined number n, the operation goes to step S42 to determine whether a defect occurs in the ink nozzle system or the optical system in step S46. When it is determined in step S42 that a defect occurs in the ink nozzle system, an alarm message is displayed by the display unit 10 in step S44. Alternatively, a cleaning operation is started automatically. After the operation is completed, it returns to step s39 to print a test pattern again. When it is determined that a defect exists in the optical system in step s46, an alarm message is displayed by the display unit 10 in step S47, and the optical system is cleaned in step S48. After the operation is completed in steps S48, it returns to step S38 to print a test pattern again. After the cleaning operation of the optical system is performed by a user in step S48, the operation returns to step S39 to read a printed test pattern again by pushing the "clear" button 61. Maintenance can be performed by repeated operations without arising any trouble, resulting in confirmation whether or not a defect in the nozzle or the optical system has been improved.

As mentioned above, the image forming apparatus according to the present invention diagnoses the nozzle and determines a defect of the optical system, and informs a user an execution of maintenance for the nozzle when any defect is detected. This enables generation of high-quality image, which is printed on a print medium. In addition, a scanner reads a test pattern for a nozzle, and then determines automatically whether a defect occurs, thereby alleviating misjudge due to each person's subjective point of view, and increasing accuracy of detection of defect, accordingly.

Further, since a determination of defect in the nozzle and the optical system is automatically performed, the time required for determining whether a defect occurs or not can be shortened, and since a cleaning operation is started when a defect in the nozzle is detected, a user can be relieved from the bothersome operation. Moreover, because the optical system is usually covered by a cover, contamination adhered to the optical system cannot be visually checked. However, according to the present invention allows a visual check by a user without lifting a cover, relieving a user from the bothersome operation. When a defect is occurred in the nozzle, the cause and the location of a defect are determined by examining the results of comparing operation. This cleans the nozzle with the minimum cleaning operation, and reduces the amounts of ink needed for cleaning and the time required for cleaning operation.

All the contents of the Japanese patent application, No. 11-172867 are incorporated into this specification by reference.

What is claimed is:

1. An image forming apparatus comprising:

a scanner which reads an image;

a print head which prints an image;

a head control unit which controls said print head to print a test pattern with said print head; and an image processing unit which diagnoses a defect in said print head and said scanner by processing the image data of the test pattern which is read by said scanner;

wherein said image processing unit determines whether a defect occurs in a nozzle in said print head or an optical system of said scanner, and said image processing apparatus further comprises a defect portion display unit which determines the location of the defect in said optical system and displays the location when the defect is occurred in said optical system.

2. An image forming apparatus comprising:

a scanner which reads an image;

a print head which prints an image;

a head control unit which controls said print head to print a test pattern with said print head; and an image processing unit which can detect simultaneously a defect in both said print head and said scanner by processing the image data of the test pattern which is read by said scanner.

3. An image forming apparatus according to claim 2, wherein said head control unit starts a test pattern printing, in response to power switch-on, a command input from a user to start printing, or a demand of a user.

4. An image forming apparatus according to claim 2, wherein said head control unit controls the print head to print the test pattern repeatedly.

5. An image forming apparatus according to claim 2, wherein said scanner reads the test pattern repeatedly.

6. An image forming apparatus according to claim 2, wherein said image processing unit determines whether a defect occurs in a nozzle in said print head or an optical system of said scanner.

7. An image forming apparatus according to claim 6, wherein said image forming apparatus further comprises a nozzle cleaning message display unit which displays a message for prompting a user to clean said ink nozzle when said image processing unit determines that a defect occurs in said ink nozzle in said print head.

8. An image forming apparatus according to claim 6, wherein said image processing unit determines the location of the defect in said ink nozzle when the defect is occurred in said nozzle, and said image forming apparatus further comprises a cleaning unit which cleans the defective portions of said ink nozzle.

9. An image forming apparatus according to claim 6, wherein said image forming apparatus further comprises a maintenance message display unit which displays a message for prompting a user to perform maintenance of said optical system.

* * * * *